US009890976B2

(12) United States Patent
Tamura et al.

(10) Patent No.: US 9,890,976 B2
(45) Date of Patent: Feb. 13, 2018

(54) AIR-CONDITIONING APPARATUS

(75) Inventors: Asako Tamura, Chiyoda-ku (JP); Naofumi Takenaka, Chiyoda-ku (JP); Shinichi Wakamoto, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 427 days.

(21) Appl. No.: 14/415,484

(22) PCT Filed: Aug. 8, 2012

(86) PCT No.: PCT/JP2012/070224

§ 371 (c)(1),
(2), (4) Date: Jan. 16, 2015

(87) PCT Pub. No.: WO2014/024276

PCT Pub. Date: Feb. 13, 2014

(65) Prior Publication Data

US 2015/0176876 A1 Jun. 25, 2015

(51) Int. Cl.
*F25B 30/02* (2006.01)
*F25B 13/00* (2006.01)
(Continued)

(52) U.S. Cl.
CPC ..... *F25B 30/02* (2013.01); *F24F 3/065* (2013.01); *F25B 13/00* (2013.01); *F25B 41/046* (2013.01);
(Continued)

(58) Field of Classification Search
CPC ..... F25B 2313/023; F25B 2313/0231; F25B 13/00; F25B 30/02; F25B 2313/003;
(Continued)

(56) References Cited

U.S. PATENT DOCUMENTS 5,729,994 A 3/1998 Mukaiyama et al.
2011/0000239 A1* 1/2011 Okamoto ..... F25B 9/008 62/203
(Continued)

FOREIGN PATENT DOCUMENTS

EP 2 314 939 A1 4/2011
EP 2 314 945 A1 4/2011
(Continued)

OTHER PUBLICATIONS

International Search Report dated Nov. 13, 2012 in PCT/JP12/070224 Filed Aug. 8, 2012.
(Continued)

*Primary Examiner* — Jonathan Bradford
(74) *Attorney, Agent, or Firm* — Oblon, McClelland, Maier & Neustadt, L.L.P.

(57) ABSTRACT

An air-conditioning apparatus includes an outdoor unit including a compressor configured to compress a first-side refrigerant and a heat-source-side heat exchanger configured to cause heat exchange between air and the first-side refrigerant, plural indoor units including indoor heat exchangers configured to cause heat exchange between the air and a second-side refrigerant, plural intermediate heat exchangers configured to cause heat exchange between the first-side and second-side refrigerants and connected to the outdoor unit by a first-side refrigerant pipe and connected to the indoor units by a second-side refrigerant pipe, and a flow switching device configured to switch combination of connection between the indoor units and the intermediate heat exchangers. The indoor units include convective indoor units and radiant indoor units, the convective indoor units include a convective indoor heat exchanger, and the radiant indoor units include a radiant indoor heat exchanger.

9 Claims, 15 Drawing Sheets

(51) Int. Cl.
*F25B 49/02* (2006.01)
*F24F 3/06* (2006.01)
*F25B 41/04* (2006.01)

(52) U.S. Cl.
CPC ..... *F25B 49/02* (2013.01); *F25B 2313/003* (2013.01); *F25B 2313/006* (2013.01); *F25B 2313/0231* (2013.01); *F25B 2313/0233* (2013.01); *F25B 2313/0234* (2013.01); *F25B 2313/0272* (2013.01); *F25B 2313/02741* (2013.01)

(58) Field of Classification Search
CPC ..... F25B 2313/006; F25B 2313/0233; F25B 2313/0234
See application file for complete search history.

(56) References Cited

U.S. PATENT DOCUMENTS

| | | | |
|---|---|---|---|
| 2011/0113802 | A1 | 5/2011 | Wakamoto et al. |
| 2011/0192184 | A1 | 8/2011 | Yamashita et al. |
| 2011/0225998 | A1 | 9/2011 | Yamashita et al. |

FOREIGN PATENT DOCUMENTS

| | | | | | |
|---|---|---|---|---|---|
| EP | 2314939 | A1 | * | 4/2011 | ..... F24F 1/02 |
| JP | 54 79936 | | | 6/1979 | |
| JP | 62-276371 | A | | 12/1987 | |
| JP | 5 288428 | | | 11/1993 | |
| JP | 6 34170 | | | 2/1994 | |
| JP | 7 43679 | | | 9/1995 | |
| JP | 8 303809 | | | 11/1996 | |
| JP | 9 310877 | | | 12/1997 | |
| JP | 10 38324 | | | 2/1998 | |
| JP | 2007 232303 | | | 9/2007 | |
| JP | 2008 14575 | | | 1/2008 | |
| JP | 2008014576 | A | * | 1/2008 | ..... F24F 3/001 |
| JP | 2011 226757 | | | 11/2011 | |
| JP | 2012-11932 | A | | 1/2012 | |
| JP | 2012011932 | A | * | 1/2012 | |
| WO | 2009 133644 | | | 11/2009 | |
| WO | 2010 113296 | | | 10/2010 | |
| WO | WO 2012/101677 | A1 | | 2/2012 | |

OTHER PUBLICATIONS

Extended European Search Report dated Mar. 10, 2016 in European Patent Application No. 12882657.5.
Office Action dated Jan. 13, 2015 in Japanese Patent Application No. 2014-529195 (with English language translation).

* cited by examiner

AIR-CONDITIONING APPARATUS

TECHNICAL FIELD

The present invention relates to an air-conditioning apparatus including a plurality of indoor units and capable of heating and cooling at the same time, such as a multi-air-conditioning apparatus for a building.

BACKGROUND ART

Indoor units in air-conditioning apparatuses placed in buildings, houses, or the like can use a convective (air-sending type) heat exchanger for forcibly exchanging heat using an blower device and a radiant (panel) heat exchanger for exchanging heat by natural convection without sending air using an blower device. The convective heat exchanger can perform quick cooling, but may cause a person to feel uncomfortable or the like by directly sending air. The radiant indoor heat exchanger can perform heating and cooling operation without directly sending air, but cannot perform rapid heating and cooling operation. An air-conditioning system including both the radiant panel heat exchanger and the convective heat exchanger has been proposed (see, for example, Patent Literature 1). Patent Literature 1 discloses an air-conditioning system that has a configuration in which the radiant panel heat exchanger is arranged on the floor side, the convective heat exchanger is arranged on the ceiling side, and the radiant panel heat exchanger and convective heat exchanger are connected in series and that circulates a refrigerant.

An air-conditioning apparatus that does not have a configuration in which an outdoor unit and indoor units are not directly connected so as to allow a refrigerant to flow therebetween but has a configuration in which it includes a first-side refrigerant circuit and a second-side refrigerant circuit and exchanges heat therebetween using an intermediate heat exchanger has been proposed (see, for example, Patent Literature 2). The air-conditioning apparatus described in Patent Literature 2 is operable principally in four operation modes of cooling only operation, heating only operation, heating main operation, and cooling main operation and can individually set the operation mode for each indoor unit using a convective heat exchanger including an blower device in accordance with the situation of the room or the like.

CITATION LIST

Patent Literature

Patent Literature 1: Japanese Unexamined Patent Application Publication No. 10-38324

Patent Literature 2: International Publication No. WO 2010/113296

SUMMARY OF INVENTION

Technical Problem

Patent Literature 1 discloses the air-conditioning system in which a single radiant panel heat exchanging portion and a single air-sending heat exchanging portion are connected. To perform heating and cooling operation for the entire structure of a building or the like, a plurality of indoor units, as illustrated in Patent Literature 2, are necessary. Not only in the case where the convective heat exchanger is used, as illustrated in Patent Literature 2, but also in the case where the radiant panel heat exchanger is used, it is desired that the indoor units be appropriately arranged and comfortable air-conditioning matching with the situation or the like of a room be provided.

The present invention is made to overcome the above-described problems. It is an object of the present invention to provide an air-conditioning apparatus capable of performing comfortable air-conditioning in accordance with the uses and arrangement of rooms inside a structure of a building or the like.

Solution to Problem

An air-conditioning apparatus according to the present invention includes an outdoor unit including a compressor configured to compress a first-side refrigerant and a heat-source-side heat exchanger configured to cause heat exchange between air and the first-side refrigerant, a plurality of indoor units including indoor heat exchangers configured to cause heat exchange between the air and a second-side refrigerant, a plurality of intermediate heat exchangers configured to cause heat exchange between the first-side refrigerant and the second-side refrigerant, the intermediate heat exchangers being connected to the outdoor unit by a first-side refrigerant pipe and connected to the indoor units by a second-side refrigerant pipe, and a flow switching device configured to switch combination of connection between each of the indoor units and each of the intermediate heat exchangers. The plurality of indoor units include convective indoor units and radiant indoor units, each of the convective indoor units includes a convective indoor heat exchanger, and each of the radiant indoor units includes a radiant indoor heat exchanger. The second-side refrigerant flowing out of each of the convective indoor units in the cooling operation flows in the radiant indoor units, and the second-side refrigerant is supplied to each of the radiant indoor heat exchanger after the temperature of the second-side refrigerant rises by the heat exchange of the convective indoor heat exchanger.

Advantageous Effects of Invention

The air-conditioning apparatus according to the present invention is an air-conditioning system including indoor units including convective heat exchangers and radiant indoor heat exchangers. This air-conditioning apparatus can perform air-conditioning in accordance with the use and load of each room, while at the same time greater space and energy savings are achieved, in comparison with cases where both a convective air-conditioning system and a radiant air-conditioning system are installed.

DESCRIPTION OF EMBODIMENTS

Embodiment 1

Figure 1:
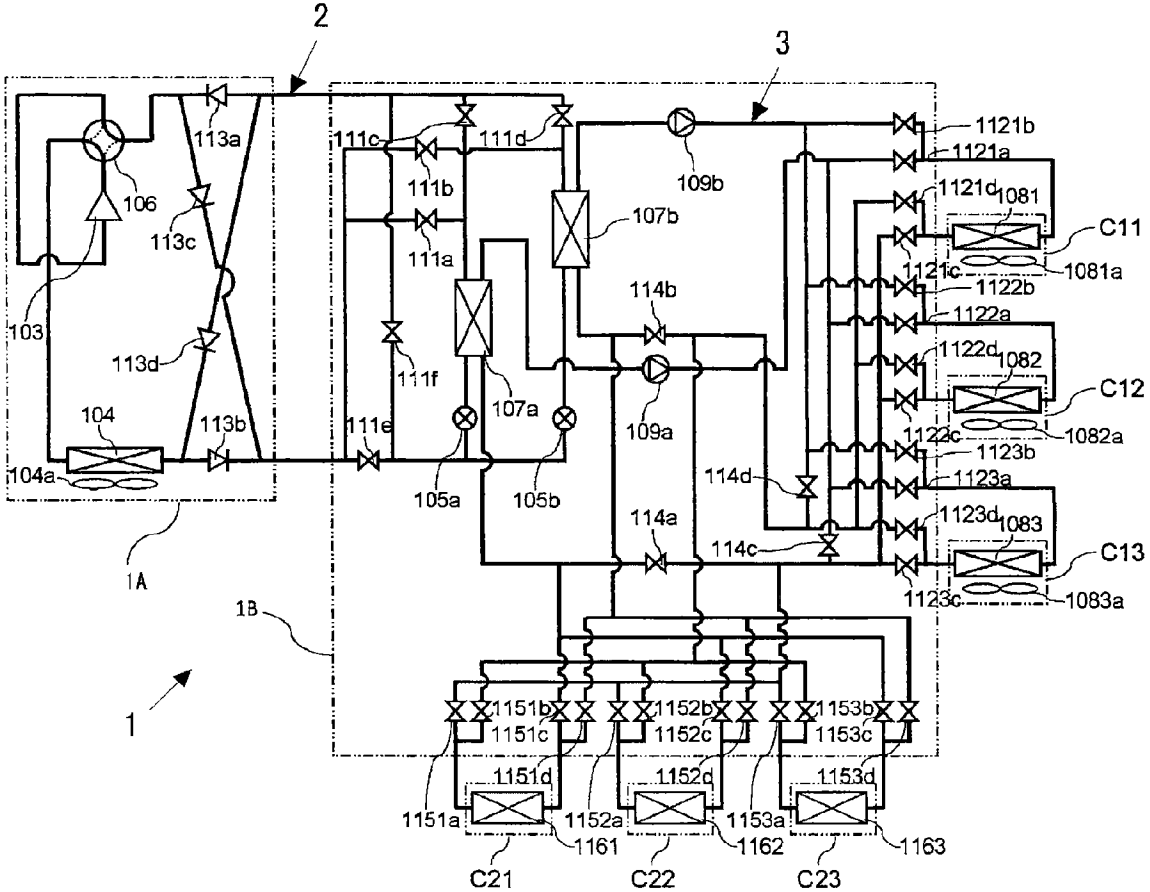
FIG. 1 is a refrigerant circuit diagram that illustrates Embodiment 1 of an air-conditioning apparatus of the present invention.

FIG. 1 is a refrigerant circuit diagram that illustrates Embodiment 1 of an air-conditioning apparatus of the present invention. As illustrated in FIG. 1, when an air-conditioning apparatus 1 is considered in units, it includes an outdoor unit 1A being a heat source device, a plurality of indoor units C1*n* and C2*m* (hereinafter referred to simply as indoor units C when they are referred to without distinction), and an intermediate unit 1B. The letters m and n are natural numbers more than zero, m indicates the number of radiant indoor heat exchangers, and n indicates the number of convective indoor heat exchangers. In Embodiment 1, the case where m is three and n is three is illustrated. The outdoor unit 1A and intermediate unit 1B are connected by a first refrigerant pipe. The intermediate unit 1B and each of the plurality of indoor units C are connected by a second refrigerant pipe. Cooling energy or heating energy produced by the outdoor unit 1A is conveyed to the indoor units C1*n* and C2*m* through the intermediate unit 1B.

(Configuration of Outdoor Unit 1A)

The outdoor unit 1A is typically placed in an outside space, such as one on the roof of a building, and is configured to supply cooling energy or heating energy to the indoor units C1*n* and C2*m* through the intermediate unit 1B. The outdoor unit 1A includes a compressor 103, a heat-source-side heat exchanger 104, and a first flow switching device 106. The compressor 103 is configured to suck a first-side refrigerant in gaseous state, compress it to a high-temperature and high-pressure state, and discharge it. One example of the compressor 103 may be an inverter compressor having a controllable capacity. The heat-source-side heat exchanger 104 functions as a radiator in cooling operation and as an evaporator in heating operation and is configured to cause heat exchange between outdoor air supplied through a fan 104*a* and the first-side refrigerant.

The first flow switching device 106 may include, for example, a four-way valve and is configured to switch a flow of the first-side refrigerant in cooling operation (cooling only operation mode and cooling main operation mode) and in heating operation (heating only operation mode and heating main operation mode). Specifically, in cooling operation, the first flow switching device 106 switches the refrigerant passage such that the first-side refrigerant discharged from the compressor 103 flows into the heat-source-side heat exchanger 104 and the first-side refrigerant exiting from the intermediate unit 1B flows into the compressor 103. In heating operation, the first flow switching device 106 switches the refrigerant passage such that the first-side refrigerant discharged from the compressor 103 flows into the intermediate unit 1B and the first-side refrigerant exiting from the heat-source-side heat exchanger 104 flows into the compressor 103.

Four check valves 113*a* to 113*d* each has the function of limiting the passing direction in which the first-side refrigerant passes between the outdoor unit 1A and intermediate unit 1B to a fixed direction. The check valve 113*a* is disposed on a refrigerant pipe connecting the first flow switching device 106 and valves 111*c* and 111*d* and allows the first-side refrigerant to flow in only a direction from the valves 111*c* and 111*d* toward the first flow switching device 106. The check valve 113*b* is disposed on a refrigerant pipe connecting the heat-source-side heat exchanger 104 and a valve 111*e* and allows the first-side refrigerant to flow in only a direction from the heat-source-side heat exchanger 104 toward the valve 111*e*. The check valve 113*c* is disposed on a refrigerant pipe that connects a refrigerant pipe connecting the first flow switching device 106 and the check valve 113*a* and a refrigerant pipe connecting the check valve 113*b* and the valve 111*e* and allows the first-side refrigerant to flow in only a direction from the side of the refrigerant pipe connecting the first flow switching device 106 and the check valve 113*a* toward the side of the refrigerant pipe connecting the check valve 113*b* and the valve 111*e*. The check valve 113*d* is disposed on a refrigerant pipe that connects a refrigerant pipe connecting the check valve 113*a* and the valves 111*c* and 111*d* and a refrigerant pipe connecting the heat-source-side heat exchanger 104 and the check valve 113*b* and allows the first-side refrigerant to flow in only a direction from the side of the refrigerant pipe connecting the check valve 113*a* and the valves 111*c* and 111*d* toward the side of the refrigerant pipe connecting the heat-source-side heat exchanger 104 and the check valve 113*b*.

(Configuration of Intermediate Unit 1B)

The intermediate unit 1B may be disposed on a location or the like different from the outdoor space and indoor space as a housing different from the outdoor unit 1A and indoor units C and is connected to the outdoor unit 1A through the first refrigerant pipe and to the indoor units C through the second refrigerant pipes. The intermediate unit 1B includes intermediate heat exchangers 107*a* and 107*b*, expansion mechanisms 105*a* and 105*b*, pumps 109*a* and 109*b*, and valves 111*a* to 111*f*, 112*na* to 112*nd*, 115*ma* to 115*md*, and 114*a* to 114*d*. The intermediate unit 1B is connected to the outdoor unit 1A by the first refrigerant pipe through the expansion mechanisms 105*a* and 105*b* and the valves 111*a* to 111*f*. The intermediate unit 1B is connected to each of the plurality of indoor units C, which are the indoor units C1*n* and C2*m*, through the pumps 109*a* and 109*b* and the valves 112*na* to 112*nd*, 115*ma* to 115*dm*, and 114*a* to 114*d*.

Examples of each of the intermediate heat exchangers 107*a* and 107*b* may include a double pipe heat exchanger, plate heat exchanger, microchannel water heat exchanger, and shell and tube heat exchanger. Each of the intermediate heat exchangers 107*a* and 107*b* includes a refrigerant passage through which the first-side refrigerant passes and a refrigerant passage through which the second-side refrigerant passes. Each of the intermediate heat exchangers 107*a* and 107*b* functions as a radiator or evaporator and causes heat exchange between the first-side refrigerant and the second-side refrigerant. That is, the intermediate heat exchangers 107*a* and 107*b* cause heat exchange between the first-side refrigerant circulating in a first-side refrigerant circuit 2 and the second-side refrigerant circulating in a second-side refrigerant circuit 3.

The intermediate heat exchanger 107*a* is disposed between the expansion mechanism 105*a* and the valve 111*c* on the side of the first-side refrigerant circuit 2 and between the valve 114*a* and the pump 109*a* on the side of the second-side refrigerant circuit 3. The intermediate heat exchanger 107*b* is disposed between the expansion mechanism 105*b* and the valve 111*d* on the side of the first-side refrigerant circuit 2 and between the valve 114*b* and the pump 109*b* on the side of the second-side refrigerant circuit 3. When the intermediate heat exchangers 107*a* and 107*b* are plate heat exchangers, in consideration of phase change of the first-side refrigerant, they may preferably be oriented such that, when the first-side refrigerant removes heat, the first-side refrigerant flows therein from below and, when the first-side refrigerant rejects heat, the first-side refrigerant flows therein from above.

One example of each of the expansion mechanisms 105*a* and 105*b* may be a mechanism having a variably controllable opening degree (opening size), such as an electronic expansion valve. Each of the expansion mechanisms 105*a* and 105*b* has the function as a pressure reducing and expansion valve configured to reduce the pressure of the first-side refrigerant in the first-side refrigerant circuit 2 and expand it. The expansion mechanism 105*a* is disposed between the intermediate heat exchanger 107*a* and the valve 111*e*. The expansion mechanism 105*b* is disposed between the intermediate heat exchanger 107*b* and the valve 111*e*.

One example of each of the third flow switching devices 111*a* to 111*f* may be a two-way valve. They are configured to switch the passage of the first-side refrigerant flowing to and exiting from the intermediate heat exchangers 107*a* and 107*b* through the first refrigerant pipe in the first-side refrigerant circuit 2. Specifically, the valve 111*a* is disposed on a refrigerant pipe that connects a refrigerant pipe connecting the intermediate heat exchanger 107*a* and the valve 111*c* and a refrigerant pipe connecting the valve 111*b* and the check valve 113*b* (or valve 111*f*). The valve 111*b* is disposed on a refrigerant pipe that connects a refrigerant pipe connecting the intermediate heat exchanger 107*b* and the valve 111*d* and a refrigerant pipe connecting the valve 111*a* and the check valve 113*b* (or valve 111*f*). The valve 111*c* is disposed on a refrigerant pipe connecting the check valve 113*a* and the intermediate heat exchanger 107*a*. The valve 111*d* is disposed on a refrigerant pipe connecting the check valve 113*a* and the intermediate heat exchanger 107*b*. The valve 111*e* is disposed on a refrigerant pipe connecting the expansion mechanism 105*a* (or expansion mechanism 105*b*) and the check valve 113*a*. The valve 111*f* is disposed on a refrigerant pipe that bypasses the check valves 113*a* and 113*b*. In place of the four valves 111*a* to 111*d*, two four-way valves disposed on the intermediate heat exchangers 107*a* and 107*b*, respectively, may be disposed.

The pumps 109*a* and 109*b* are configured to pump and circulate the second-side refrigerant inside the second-side refrigerant circuit 3. One example of each of the pumps 109*a* and 109*b* may be a pump having a controllable capacity. The suction side of the pump 109*a* is connected to the intermediate heat exchanger 107*a*, and its discharge side is separated and connected to the plurality of valves 112*na*. The suction side of the pump 109*b* is connected to the intermediate heat exchanger 107*b*, and its discharge side is separated and connected to the plurality of valves 112*nb*.

A second flow switching device includes the valves 112*na* to 112*nd*, 114*a* to 114*d*, and 115*ma* to 115*md*. The valves 112*na*, 112*nb*, 112*nc*, and 112*nd* are configured to switch the second-side refrigerant passage to be delivered to convective indoor heat exchangers 108*n* in the convective indoor units C1*n*. The valves 115*ma*, 115*dm*, 114*a*, and 114*b* are configured to switch the second-side refrigerant passage for delivering the refrigerant to indoor heat exchangers 116*m* in the radiant indoor units C2*m*. The flow rates of the flows of the second-side refrigerant passing through the indoor heat exchangers 108*n* and 116*m* are controlled by adjustment of the opening degrees (opening sizes) of the valves 112*na* to 112*nd* and 115*ma* to 115*md*.

(Configurations of Indoor Units C1*n* and C2*m*)

The air-conditioning apparatus 1 includes the convective indoor units C1*n* including only the convective indoor heat exchangers 108*n* and the radiant indoor units C2*m* including only the radiant indoor heat exchangers 116*m*. Each of the convective indoor units C1*n* includes the convective indoor heat exchanger 108*n* and an blower device 108*na* and is configured to perform air-conditioning by heating operation or cooling operation for an indoor space. The convective indoor heat exchanger 108*n* functions as a radiator in heating operation and as an evaporator in cooling operation. The convective indoor heat exchanger 108*n* causes heat exchange between indoor air supplied from the blower device and the second-side refrigerant and produces air for heating or air for cooling to be supplied to the indoor space. The refrigerant pipe connected to one side of the convective indoor heat exchanger 108*n* is separated into the routes connected to the valves 112*na* and 112*nb*, respectively. The refrigerant pipe connected to another side of the convective indoor heat exchanger 108*n* is separated into the routes connected to the valves 112*nc* and 112*nd*, respectively.

Each of the radiant indoor units C2*m* includes the radiant indoor heat exchanger (chilled beam) 116*m* and is configured to perform air-conditioning by heating operation or cooling operation for the indoor space to which it is equipped. The radiant indoor heat exchanger 116*m* functions as a radiator in heating operation and as an evaporator in cooling operation. Because the radiant indoor heat exchanger 116*m* does not include an blower device, it causes heat exchange between indoor air supplied by natural convection and the second-side refrigerant and produces air for heating or air for cooling to be supplied to the indoor space. The refrigerant pipe connected to one side of the radiant indoor heat exchanger 116*m* is separated into the routes connected to the valves 115*ma* and 115*mb*, respectively. The refrigerant pipe connected to another side of the radiant indoor heat exchanger 116*m* is separated into the routes connected to the valves 115*mc* and 115*md*, respectively.

Here, the plurality of convective indoor heat exchangers 108*n* are connected in parallel with each other, and the plurality of radiant indoor heat exchangers 116*m* are connected in parallel with each other. The plurality of radiant indoor heat exchangers 116*m* are disposed downflow of the plurality of convective indoor heat exchangers 108*n*. Thus the second-side refrigerant after heat exchange in the convective indoor heat exchangers 108*n* is supplied to the radiant indoor heat exchangers 116*m*. The intermediate unit 1B includes the pipes and valves 114*c* and 114*d* for bypassing the plurality of convective indoor heat exchangers 108*n* and is configured to enable the second-side refrigerant from the intermediate heat exchangers 107*a* and 107*b* to bypass the plurality of convective indoor heat exchangers 108*n* and to be directly supplied to the downstream radiant indoor heat exchangers 116*m*.

(Configuration of Refrigerant Circuit)

The air-conditioning apparatus 1 illustrated in FIG. 1 includes the two refrigerant circuits of the first-side refrigerant circuit 2 and the second-side refrigerant circuit 3. The first-side refrigerant circuit 2 includes the compressor 103, heat-source-side heat exchanger 104, expansion mechanisms 105*a* and 105*b*, first flow switching device 106, intermediate heat exchangers 107*a* and 107*b*, and valves 111*a* to 111*f*. The first-side refrigerant circuit 2 is configured as the refrigerant circuit by connecting the compressor 103, first flow switching device 106, heat-source-side heat exchanger 104, expansion mechanisms 105*a* and 105*b*, intermediate heat exchangers 107*a* and 107*b*, first flow switching device 106, and compressor 103 in this order by the first refrigerant pipe. Examples of the first-side refrigerant passing through the first-side refrigerant circuit 2 may include a CFC refrigerant, such as R410A or R32, a hydrocarbon refrigerant, such as a propane, and a natural refrigerant, such as carbon dioxide. As the first-side refrigerant, an azeotropic refrigerant mixture, such as one including R410A, or a non-azeotropic refrigerant mixture, such as one including R407C, R32, and R134a or one including R32 and R1234yf.

The second-side refrigerant circuit 3 includes the intermediate heat exchangers 107*a* and 107*b*, convective indoor heat exchangers 108*n*, radiant indoor heat exchangers 116*m*, pumps 109*a* and 109*b*, and valves 112*na* to 112*nd*, 115*ma* to 115*dm*, and 114*a* to 114*d*. The second-side refrigerant circuit 3 is configured as the refrigerant circuit by connecting the pumps 109*a* and 109*b*, convective indoor heat exchangers 108*n*, radiant indoor heat exchangers 116*m*, intermediate heat exchangers 107*a* and 107*b*, and pumps 109*a* and 109*b* in this order by the second refrigerant pipe. Examples of the second-side refrigerant passing through the second-side refrigerant circuit may include antifreeze (brine), water, a mixture thereof, and a mixture of water and an anticorrosive additive. The use of such a second-side refrigerant contributes to improved safety even if the second-side refrigerant leaks from the indoor unit C to the indoor space because a material having a high level of safety is used as the second-side refrigerant.

In Embodiment 1, the number of the convective indoor heat exchangers is three (n=3) and the number of the radiant indoor heat exchangers is three (m=3). However, the numbers may be one, two, four or more. The circuit structures of the above-described first-side refrigerant circuit 2 and second-side refrigerant circuit 3 are based on the refrigerant circuits through which the refrigerant of the same type passes.

The operation modes which the air-conditioning apparatus of Embodiment 1 can operate may include the cooling only operation mode, where all of the indoor units C perform cooling operation, the heating only operation mode, where all of the indoor units C perform heating operation, the cooling main operation mode, where cooling operation or heating operation can be selected for each of the indoor units C and the cooling load is the larger, and the heating main operation mode, where cooling operation or heating operation can be individually selected for each of the indoor units C and the heating load is the larger. Each of the operation modes is described below with the streams of the first-side refrigerant and second-side refrigerant.

(Cooling Only Operation Mode)

Figure 2:
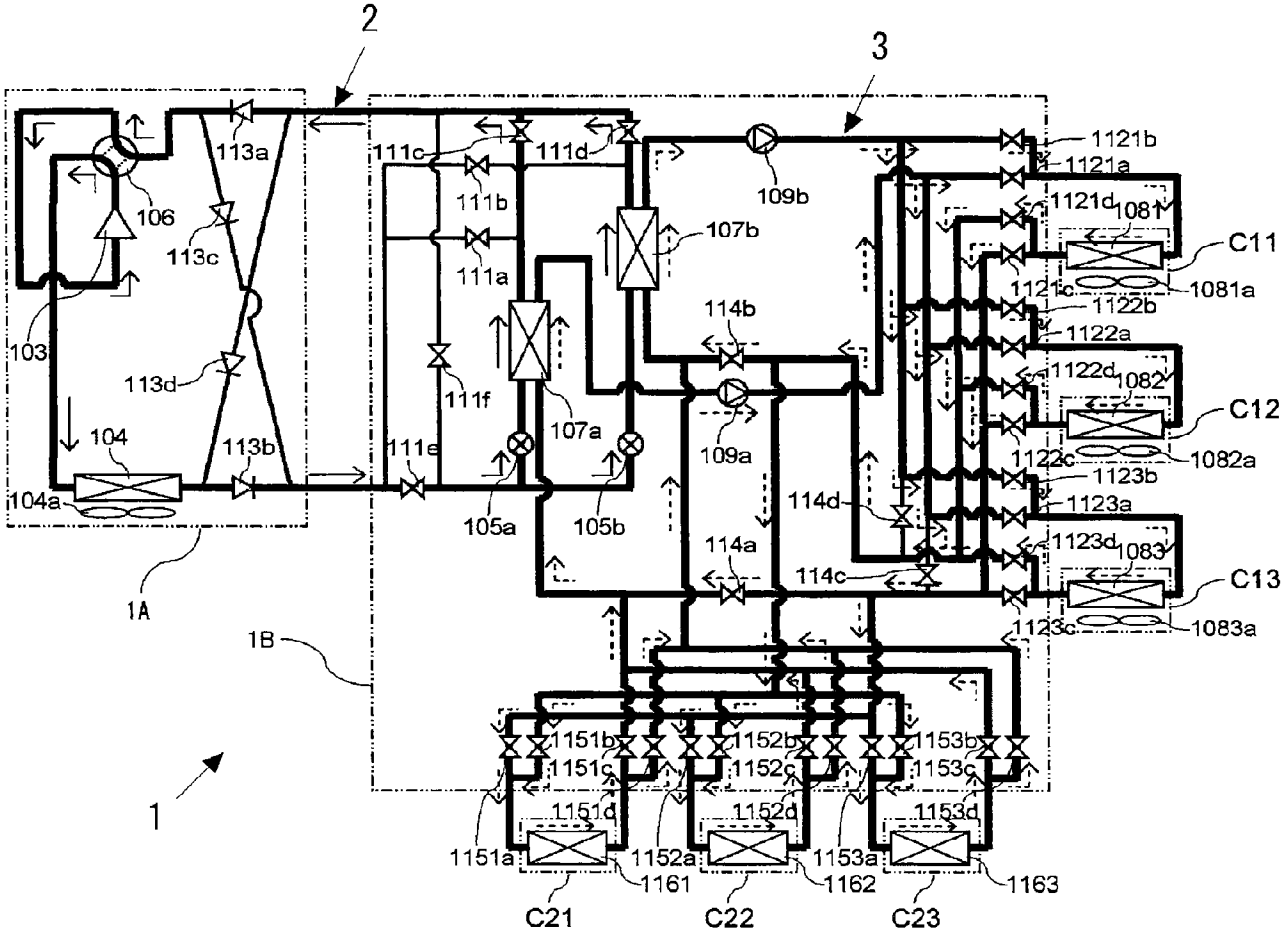
FIG. 2 is a refrigerant circuit diagram that illustrates streams of a first-side refrigerant and a second-side refrigerant in cooling only operation mode in the air-conditioning apparatus illustrated in FIG. 1.

FIG. 2 is a refrigerant circuit diagram that illustrates the streams of the first-side refrigerant and second-side refrigerant in cooling only operation mode in the air-conditioning apparatus 1 illustrated in FIG. 1. In FIG. 2, the pipes indicated by the thick lines represent the pipes through which the first-side refrigerant and second-side refrigerant pass, the directions in which the first-side refrigerant flows are indicated by the solid line arrows, and the directions in which the second-side refrigerant flows are indicated by the broken line arrows. The same applies to FIGS. 3 to 7. The cooling only operation mode is described below with reference to FIG. 2.

In the first-side refrigerant circuit 2, the first flow switching device 106 is switched in advance such that the first-side refrigerant discharged from the compressor 103 flows into the heat-source-side heat exchanger 104 and the first-side refrigerant exiting from the intermediate unit 1B flows into the compressor 103. The valves 111*a*, 111*b*, and 111*f* are in a closed state, and the valves 111*c*, 111*d*, and 111*e* are in an opened state. In the second-side refrigerant circuit, the valves 112*na* to 112*nd*, 114*a*, 114*b*, and 115*ma* to 115*dm* are in an open state, and the valves 114*c* and 114*d* are in a closed state.

The first-side refrigerant in a low-temperature and low-pressure gaseous state is compressed by the compressor 103 to a high-temperature and high-pressure state. The first-side refrigerant is discharged from the compressor 103, passes through the first flow switching device 106, flows into the heat-source-side heat exchanger 104, and transfers heat to the outdoor air. The first-side refrigerant is partially or entirely condensed to a gas-liquid two-phase state or liquid state. The first-side refrigerant in the gas-liquid two-phase state or liquid state exiting from the heat-source-side heat exchanger 104 passes through the check valve 113*b*, exits from the outdoor unit 1A, and flows into the intermediate unit 1B. The first-side refrigerant flowing to the intermediate unit 1B passes through the valve 111*e* and is divided into portions, and the portions flow into the expansion mechanisms 105*a* and 105*b*, respectively, are thus expanded and decompressed, become a low-temperature and low-pressure gas-liquid two-phase state, and flow into the intermediate heat exchangers 107*a* and 107*b*, respectively, in parallel with each other.

The first-side refrigerant in the gas-liquid two-phase state flowing to each of the intermediate heat exchangers 107*a* and 107*b* receives heat from the second-side refrigerant, evaporates, and becomes a low-temperature and low-pressure gaseous state. The first-side refrigerants in the low-temperature and low-pressure gaseous state exiting from the intermediate heat exchangers 107*a* and 107*b* pass through the valves 111*c* and 111*d* and then marge together. The merged first-side refrigerant exits from the intermediate unit 1B and flows into the outdoor unit 1A. The first-side refrigerant in the gaseous state flowing to the outdoor unit 1A passes through the check valve 113*a* and first flow switching device 106, is sucked into the compressor 103, and is compressed again.

Next, the flow of the second-side refrigerant in the second-side refrigerant circuit is described. The low-temperature second-side refrigerant is caused to exit from the intermediate heat exchanger 107*a* by driving of the pump 109*a*, passes through the valves 112*na*, and then flows into the convective indoor heat exchangers 108*n* in the convective indoor units C1*n*. Similarly, the low-temperature second-side refrigerant is caused to exit from the intermediate heat exchanger 107*b* by driving of the pump 109*b*, passes through the valves 112*nb*, and then flows into the convective indoor heat exchangers 108*n* in the convective indoor units C1*n*. The second-side refrigerant flowing from the intermediate unit 1B to each of the convective indoor heat exchangers 108*n* in the above-described way cools the indoor air, becomes a high-temperature state, exits from the convective indoor units C1*n*, and flows into the intermediate unit 1B.

The second-side refrigerant exiting from each of the convective indoor heat exchangers 108*n* is divided into a portion that is to return to the intermediate heat exchangers 107*a* and 107*b* and another portion that is to flow into the radiant indoor units. Specifically, the second-side refrigerant is divided into a second-side refrigerant portion that is to flow into the intermediate heat exchanger 107*a* through the valves 112*nc* and 114*a* and another second-side refrigerant portion that moves from the valves 112*nc* toward the radiant indoor units C2*m*. Similarly, the second-side refrigerant is divided into a second-side refrigerant portion that is to flow into the intermediate heat exchanger 107*b* through the valves 112*nd* and 114*b* and another second-side refrigerant portion that moves from the valves 112*nd* toward the radiant indoor units C2*m*.

The second-side refrigerant flowing toward the radiant indoor units C2*m* passes through the valves 115*ma*, then exits from the intermediate unit 1B, and flows into the radiant indoor heat exchangers 116*m* in the radiant indoor units C2*m*. The second-side refrigerant flowing from the convective indoor units C1*n* and flowing to the convective indoor heat exchangers 108*n* through the intermediate unit 1B in this way cools the indoor air, becomes a high-temperature state, exits from the convective indoor units C1*n*, and flows into the intermediate unit 1B.

The second-side refrigerant exiting from the radiant indoor heat exchangers 116*m* flows into the intermediate unit 1B. The second-side refrigerant flows into the intermediate heat exchanger 107*a* through the valves 115*mc* and into the intermediate heat exchanger 107*b* through the valves 115*dm*. The flows of the second-side refrigerant flowing to the intermediate heat exchangers 107*a* and 107*b* are cooled by the first-side refrigerant in the low-temperature state and exit from the intermediate heat exchangers 107*a* and 107*b*, respectively. The flows of the second-side refrigerant exiting from the intermediate heat exchangers 107*a* and 107*b* flow into the pumps 109*a* and 109*b*, respectively, and are ejected again.

(Heating Only Operation Mode)

Figure 3:
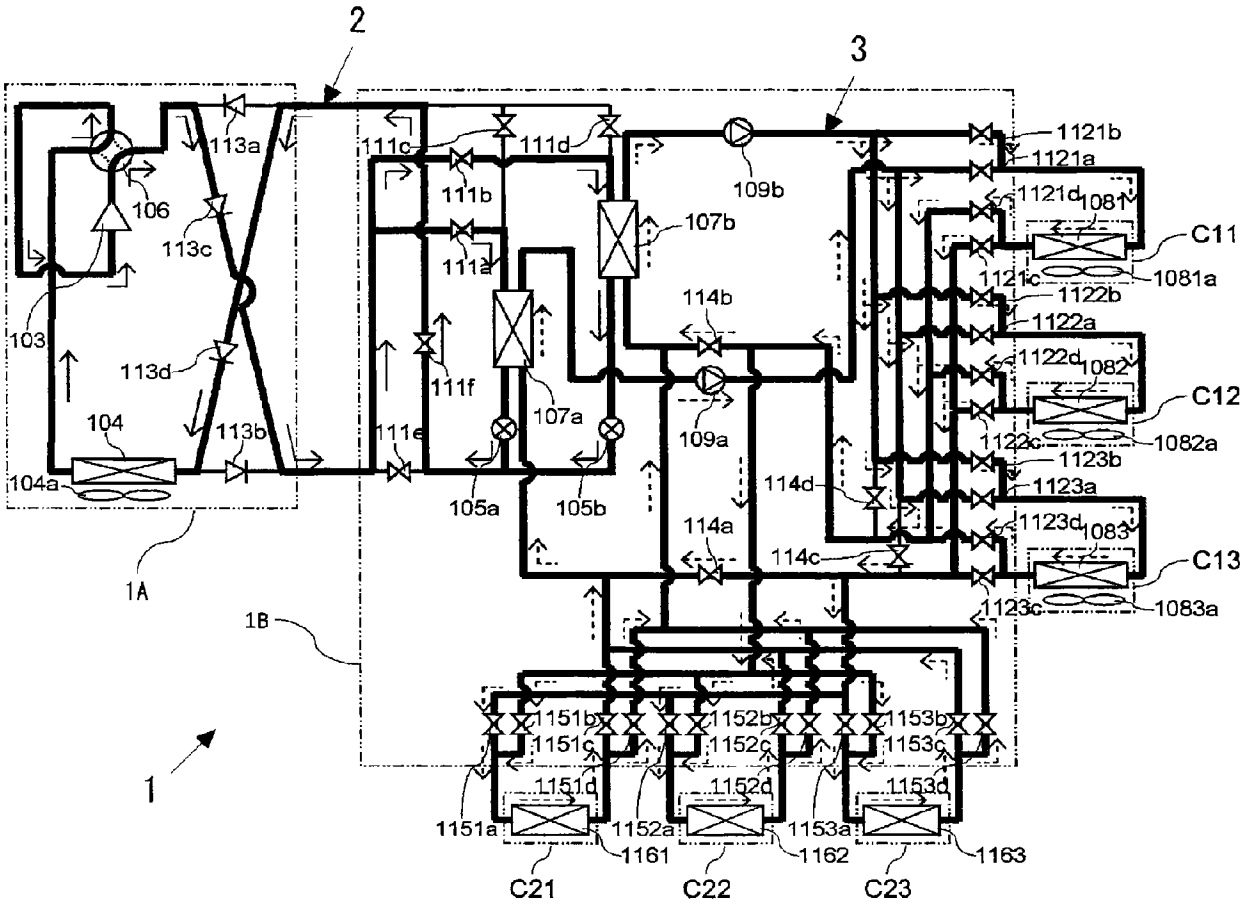
FIG. 3 is a refrigerant circuit diagram that illustrates the streams of the first-side refrigerant and the second-side refrigerant in heating only operation mode in the air-conditioning apparatus illustrated in FIG. 1.

FIG. 3 is a refrigerant circuit diagram that illustrates the streams of the first-side refrigerant and second-side refrigerant in heating only operation mode in the air-conditioning apparatus 1 illustrated in FIG. 1. The heating only operation mode is described below with reference to FIG. 3. In the first-side refrigerant circuit 2, the first flow switching device 106 is switched in advance such that the first-side refrigerant discharged from the compressor 103 flows into the intermediate unit 1B and the first-side refrigerant exiting from the heat-source-side heat exchanger 104 flows into the compressor 103. The valves 111*a*, 111*b*, and 111*f* are in an open state, and the valves 111*c*, 111*d*, and 111*e* are in a closed state. In the second-side refrigerant circuit, the valves 112*na* to 112*nd*, 114*a*, 114*b*, and 115*ma* to 115*dm* are in an open state, and the valves 114*c* and 114*d* are in a closed state, as in the case of the cooling only operation mode.

The first-side refrigerant in a low-temperature and low-pressure gaseous state is compressed by the compressor 103 to a high-temperature and high-pressure state. The first-side refrigerant is discharged from the compressor 103, passes through the first flow switching device 106 and check valve 113*c*, exits from the outdoor unit 1A, and flows into the intermediate unit 1B. The first-side refrigerant flowing to the intermediate unit 1B is divided into portions that are to flow into the intermediate heat exchangers 107*a* and 107*b* in parallel with each other through the valves 111*a* and 111*b*, respectively. The first-side refrigerants in the high-temperature and high-pressure state flowing to the intermediate heat exchangers 107*a* and 107*b* transfer heat to the second-side refrigerant and are partially or entirely condensed to a gas-liquid two-phase state or liquid state. The first-side refrigerants in the gas-liquid two-phase state or liquid state exiting from the intermediate heat exchangers 107*a* and 107*b* flow into the expansion mechanisms 105*a* and 105*b*, respectively, are thus expanded and decompressed, and become a low-temperature and low-pressure gas-liquid two-phase state. After that, the first-side refrigerants exiting from the expansion mechanisms 105*a* and 105*b* merge with each other, and the merged first-side refrigerant passes through the valve 111*f*, exits from the intermediate unit 1B, and flows into the outdoor unit 1A. The first-side refrigerant in the gas-liquid two-phase state flowing to the outdoor unit 1A passes through the check valve 113*d*, flows into the heat-source-side heat exchanger 104, receives heat from the outdoor air, evaporates, becomes a low-temperature and low-pressure gaseous state, passes through the first flow switching device 106, is sucked into the compressor 103, and is compressed again.

The flow of the second-side refrigerant in the second-side refrigerant circuit is substantially the same as those in the cooling only operation mode, and only heat movements different from those in the cooling only operation mode are described below. The high-temperature flows of the second-side refrigerant from the pumps 109*a* and 109*b* heat the indoor air in the convective heat exchangers 108*n*, become a low-temperature state, heat the indoor air in the radiant indoor heat exchangers 116*m*, become a further lower temperature state, and are then heated in the intermediate heat exchangers 107*a* and 107*b* by the first-side refrigerant in the high-temperature state. The flows of the second-side refrigerant in the high-temperature state flow into the pumps 109*a* and 109*b* and are ejected again.

(Cooling Main Operation Mode 1)

Figure 4:
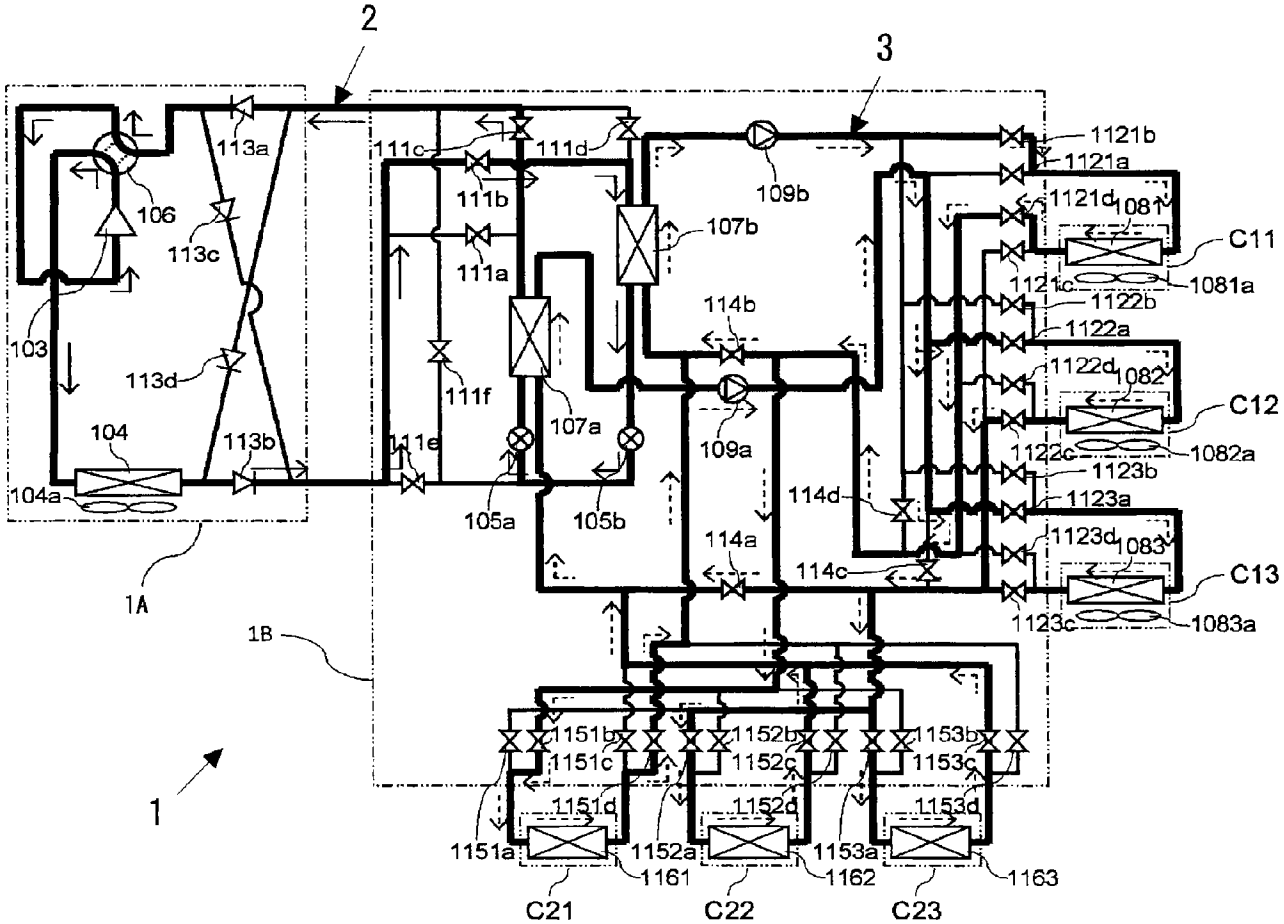
FIG. 4 is a refrigerant circuit diagram that illustrates the streams of the first-side refrigerant and the second-side refrigerant in cooling main operation mode 1 in the air-conditioning apparatus illustrated in FIG. 1.

FIG. 4 is a refrigerant circuit diagram that illustrates the streams of the first-side refrigerant and the second-side refrigerant in cooling main operation mode 1 in the air-conditioning apparatus 1 illustrated in FIG. 1. The cooling main operation mode 1 is the operation mode in which the cooling load is larger than the heating load and at least one of the convective indoor units C1*n* performs heating operation. In FIG. 4, the convective indoor unit C11 and radiant indoor unit C21 perform heating operation, and the convective indoor units C12 and C13 and radiant indoor units C22 and C23 perform cooling operation.

In the first-side refrigerant circuit 2, the first flow switching device 106 is switched in advance such that the first-side refrigerant discharged from the compressor 103 flows into the heat-source-side heat exchanger 104 and the first-side refrigerant exiting from the intermediate unit 1B flows into the compressor 103. The valves 111*a*, 111*d*, 111*e*, and 111*f* are in a closed state, and the valves 111*b* and 111*c* are in an open state. In the second-side refrigerant circuit, the valves 1121*b*, 1121*d*, 1122*a*, 1122*c*, 1123*a*, 1123*c*, 114*a*, 114*b*, 1151*b*, 1151*d*, 1152*a*, 1152*c*, 1153*a*, and 1153*c* are in an open state, and the valves 1121*a*, 1121*c*, 1122*b*, 1122*d*, 1123*b*, 1123*d*, 114*c*, 114*d*, 1151*a*, 1151*c*, 1152*b*, 1152*d*, 1153*b*, and 1153*d* are in a closed state.

The first-side refrigerant in a low-temperature and low-pressure gaseous state is compressed by the compressor 103, becomes a high-temperature and high-pressure state, is discharged, passes through the first flow switching device 106, flows into the heat-source-side heat exchanger 104, transfers heat to the outdoor air, and is partially or entirely condensed to a gas-liquid two-phase state. The first-side refrigerant in the gas-liquid two-phase state exiting from the heat-source-side heat exchanger 104 passes through the check valve 113*b*, exits from the outdoor unit 1A, and flows into the intermediate unit 1B.

The first-side refrigerant in the gas-liquid two-phase state flowing to the intermediate unit 1B passes through the valve 111*b*, flows into the intermediate heat exchanger 107*b*, heats the second-side refrigerant, and is thus further condensed. The first-side refrigerant exiting from the intermediate heat exchanger 107*b* passes through the expansion mechanisms 105*b* and 105*a*, is thus expanded and decompressed, becomes a low-temperature and low-pressure gas-liquid two-phase state, and flows into the intermediate heat exchanger 107*a*. The first-side refrigerant in the gas-liquid two-phase state flowing to the intermediate heat exchanger 107*a* receives heat from the second-side refrigerant, evaporates, and becomes a low-temperature and low-pressure gaseous state. The first-side refrigerant in the low-temperature and low-pressure gaseous state exiting from the intermediate heat exchanger 107*a* passes through the valve 111*c*, exits from the intermediate unit 1B, and flows into the outdoor unit 1A. The first-side refrigerant in the gaseous state flowing to the outdoor unit 1A passes through the check valve 113*a* and first flow switching device 106, is sucked into the compressor 103, and is compressed again.

Next, the flow of the second-side refrigerant in the second-side refrigerant circuit is described. The low-temperature second-side refrigerant ejected by driving of the pump 109*a* is divided into portions, and the portions pass through the valves 1122*a* and 1123*a*, respectively, exit from the intermediate unit 1B, and flow into the convective indoor heat exchanger 1082 in the convective indoor unit C12 and the convective indoor heat exchanger 1083 in the convective indoor unit C13, respectively. The flows of the second-side refrigerant flowing to the convective indoor heat exchangers 1082 and 1083 cool the indoor air, become a high-temperature state, exit from the convective indoor units C12 and C13, respectively, and flow into the intermediate unit 1B.

The second-side refrigerant exiting from the convective indoor heat exchanger 1082, flowing to the intermediate unit 1B, and passing through the valve 1122*c* and the second-side refrigerant exiting from the convective indoor heat exchanger 1083, flowing to the intermediate unit 1B, and passing through the valve 1123*c* merge with each other, and the merged second-side refrigerant is then divided into a portion that is to pass through the valve 114*a* and another portion that is to move toward the indoor units C22 and C23. The second-side refrigerant flowing toward the indoor units C22 and C23 is divided again into portions, and the portions pass through the valves 1152*a* and 1153*a*, respectively, exit from the intermediate unit 1B, and flow into the radiant indoor heat exchanger 1162 in the indoor unit C22 and the radiant indoor heat exchanger 1163 in the indoor unit C23, respectively. The flows of the second-side refrigerant flowing to the radiant indoor heat exchangers 1162 and 1163 cool the indoor air, become a higher temperature state, exit from the indoor units C22 and C23, respectively, and flow into the intermediate unit 1B again.

The second-side refrigerant exiting from the radiant indoor heat exchanger 1162, flowing to the intermediate unit 1B, and passing through the valve 1152*c* and the second-side refrigerant exiting from the radiant indoor heat exchanger 1163, flowing to the intermediate unit 1B, and passing through the valve 1153*c* merge with the second-side refrigerant passing through the valve 114*a*, and the merged second-side refrigerant flows into the intermediate heat exchanger 107*a*. The second-side refrigerant flowing to the intermediate heat exchanger 107*a* is cooled by the first-side refrigerant in the low-temperature state and exits from the intermediate heat exchanger 107*a*. The second-side refrigerant exiting from the intermediate heat exchanger 107*a* flows into the pump 109*a* and is ejected again.

The high-temperature second-side refrigerant ejected by driving of the pump 109*b* passes through the valve 1121*b*, exits from the intermediate unit 1B, and flows into the convective indoor heat exchanger 1081 in the convective indoor unit C11. The second-side refrigerant flowing to the convective indoor heat exchanger 1081 heats the indoor air, becomes a low-temperature state, exits from the convective indoor unit C11, and flows into the intermediate unit 1B.

The second-side refrigerant exiting from the convective indoor heat exchanger 1081, flowing to the intermediate unit 1B, and passing through the valve 1121*d* is divided into a portion that is to pass through the valve 114*b* and another portion that is to move toward the indoor unit C21. The second-side refrigerant flowing toward the indoor unit C21 passes through the valve 1151*b*, exits from the intermediate unit 1B, and flows into the radiant indoor heat exchanger 1161 in the indoor unit C21. The second-side refrigerant flowing to the radiant indoor heat exchanger 1161 cools the indoor air, becomes a higher temperature state, exits from the indoor unit C21, and flows into the intermediate unit 1B again. The second-side refrigerant exiting from the radiant indoor heat exchanger 1161, flowing to the intermediate unit 1B, and passing through the valve 1151*d* merges with the second-side refrigerant passing through the valve 114*b*, and the merged second-side refrigerant flows into the intermediate heat exchanger 107*b*. The second-side refrigerant flowing to the intermediate heat exchanger 107*b* is heated by the first-side refrigerant in the high-temperature state and exits from the intermediate heat exchanger 107*b*. The second-side refrigerant exiting from the intermediate heat exchanger 107*b* flows into the pump 109*b* and is ejected again.

(Cooling Main Operation Mode 2)

Figure 5:
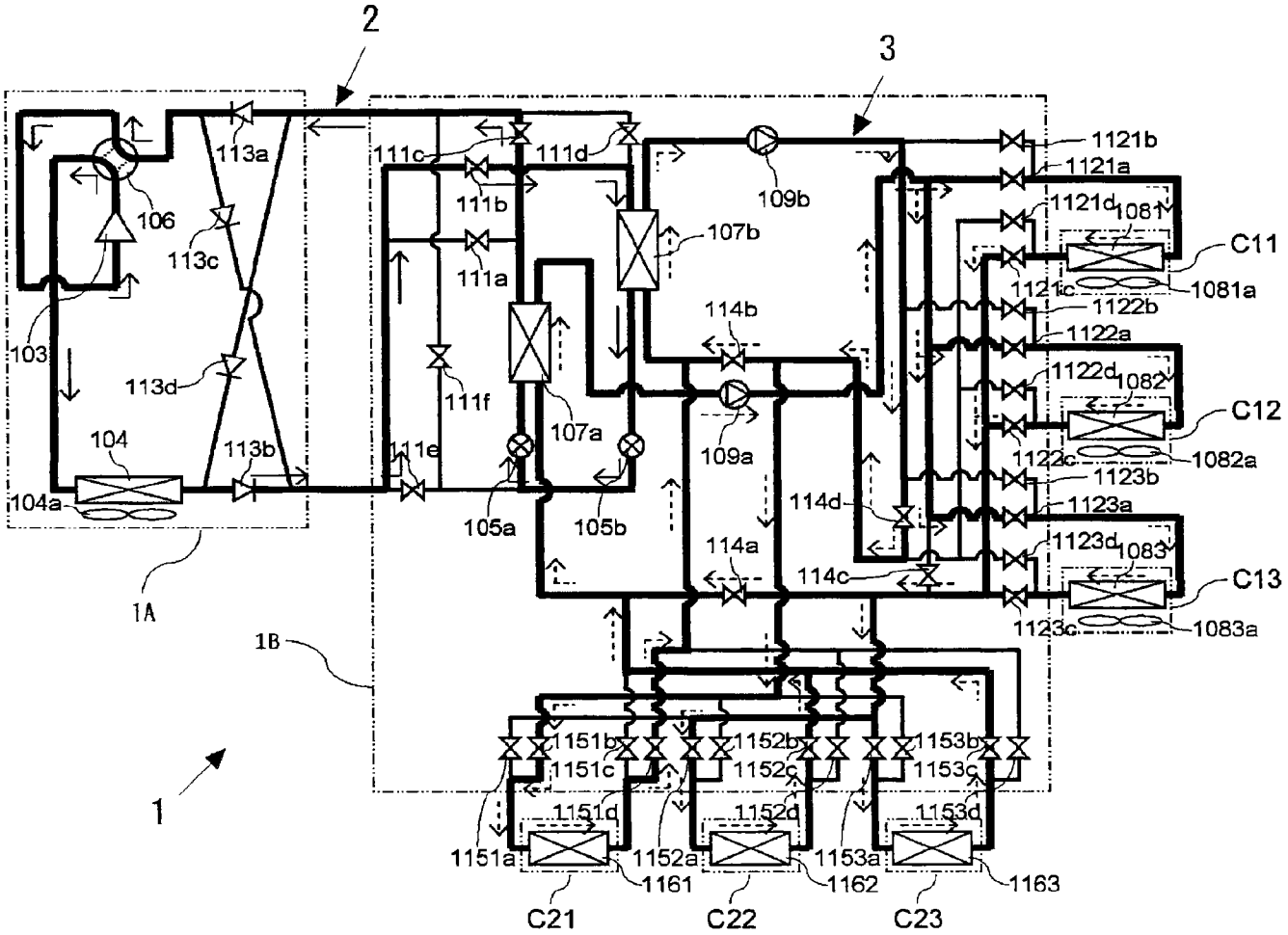
FIG. 5 is a refrigerant circuit diagram that illustrates the streams of the first-side refrigerant and the second-side refrigerant in cooling main operation mode 2 in the air-conditioning apparatus illustrated in FIG. 1.

FIG. 5 is a refrigerant circuit diagram that illustrates the streams of the first-side refrigerant and the second-side refrigerant in cooling main operation mode 2 in the air-conditioning apparatus 1 illustrated in FIG. 1. The cooling main operation mode 2 is the operation mode in which the cooling load is larger than the heating load, all of the convective indoor units C11 to C13 perform cooling operation, and at least one of the indoor units C21 to C23 performs heating operation. The cooling main operation mode 2 is described below with reference to FIG. 5. In FIG. 5, the convective indoor units C11 to C13 and radiant indoor units C22 and C23 perform cooling operation, and the radiant indoor unit C21 performs heating operation. The passage switching in the first-side refrigerant circuit 2 is substantially the same as in the cooling main operation mode 1. The flow of the second-side refrigerant in the second-side refrigerant circuit is described below.

In the second-side refrigerant circuit, the valves 1121*a* to 1123*a*, 1121*c* to 1123*c*, 114*a*, 114*b*, 114*d*, 1151*b*, 1151*d*, 1152*a*, 1152*c*, 1153*a*, and 1153*c* are in an open state, and the valves 1121*b* to 1123*b*, 1121*d* to 1123*d*, 114*c*, 1151*a*, 1151*c*, 1152*b*, 1152*d*, 1153*b*, and 1153*d* are in a closed state.

The low-temperature second-side refrigerant ejected by driving of the pump 109*a* is divided into portions, and the portions pass through the valves 1121*a*, 1122*a*, and 1123*a*, respectively, exit from the intermediate unit 1B, and flow into the convective indoor heat exchanger 1081 in the convective indoor unit C11, the convective indoor heat exchanger 1082 in the convective indoor unit C12, and the convective indoor heat exchanger 1083 in the convective indoor unit C13, respectively. The flows of the second-side refrigerant flowing to the convective indoor heat exchangers 1081, 1082, and 1083 cool the indoor air, become a high-temperature state, exit from the convective indoor units C11, C12, and C13, respectively, and flow into the intermediate unit 1B.

The second-side refrigerant passing through the valve 1121*c* and flowing to the intermediate unit 1B, the second-side refrigerant passing through the valve 1122*c* and flowing to the intermediate unit 1B, and the second-side refrigerant passing through the valve 1123*c* and flowing to the intermediate unit 1B are divided into a portion that is to pass through the valve 114*a* and another portion that is to move toward the indoor units C22 and C23. The second-side refrigerant flowing toward the indoor units C22 and C23 is further divided into portions, and the portions pass through the valves 1152*a* and 1153*a*, respectively, exit from the intermediate unit 1B, and flow into the radiant indoor heat exchanger 1162 in the indoor unit C22 and the radiant indoor heat exchanger 1163 in the indoor unit C23, respectively.

The flows of the second-side refrigerant flowing to the radiant indoor heat exchangers 1162 and 1163 cool the indoor air, become a higher temperature state, exit from the indoor units C22 and C23, respectively, and flows into the intermediate unit 1B again. The second-side refrigerant exiting from the radiant indoor heat exchanger 1162, flowing to the intermediate unit 1B, and passing through the valve 1152*c* and the second-side refrigerant exiting from the radiant indoor heat exchanger 1163, flowing to the intermediate unit 1B, and passing through the valve 1153*c* merge with the second-side refrigerant passing through the valve 114*a*, and the merged second-side refrigerant flows into the intermediate heat exchanger 107*a*. The second-side refrigerant flowing to the intermediate heat exchanger 107*a* is cooled by the first-side refrigerant in the low-temperature state and exits from the intermediate heat exchanger 107*a*. The second-side refrigerant exiting from the intermediate heat exchanger 107*a* flows into the pump 109*a* and is ejected again.

The high-temperature second-side refrigerant ejected by driving of the pump 109*b* passes through the valve 114*d* and is then divided into a portion that is to pass through the valve 114*b* and another portion that is to move toward the indoor unit C21. The second-side refrigerant flowing toward the indoor unit C21 passes through the valve 1151*b*, exits from the intermediate unit 1B, and flows into the radiant indoor heat exchanger 1161 in the indoor unit C21. The second-side refrigerant flowing to the radiant indoor heat exchanger 1161 heats the indoor air, becomes a low-temperature state, exits from the indoor unit C21, and flows into the intermediate unit 1B. The second-side refrigerant exiting from the radiant indoor heat exchanger 1161, flowing to the intermediate unit 1B, and passing through the valve 1151*d* merges with the second-side refrigerant passing through the valve 114*b*, and the merged second-side refrigerant flows into the intermediate heat exchanger 107*b*. The second-side refrigerant flowing to the intermediate heat exchanger 107*b* is heated by the first-side refrigerant in the high-temperature state and exits from the intermediate heat exchanger 107*b*. The second-side refrigerant exiting from the intermediate heat exchanger 107*b* flows into the pump 109*b* and is ejected again.

(Heating Main Operation Mode 1)

Figure 6:
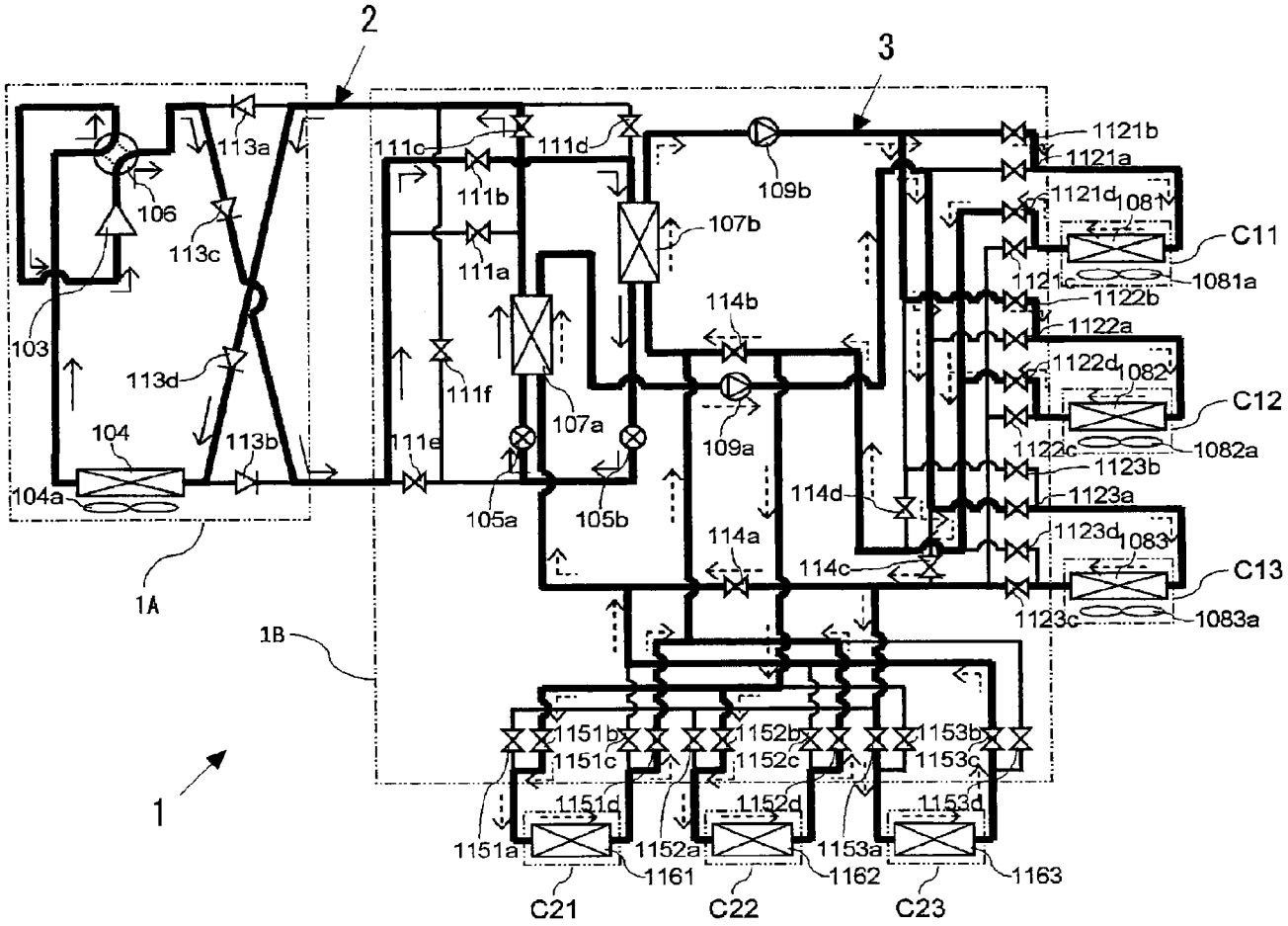
FIG. 6 is a refrigerant circuit diagram that illustrates the streams of the first-side refrigerant and the second-side refrigerant in heating main operation mode 1 in the air-conditioning apparatus 1 illustrated in FIG. 1.

FIG. 6 is a refrigerant circuit diagram that illustrates the streams of the first-side refrigerant and the second-side refrigerant in heating main operation mode 1 in the air-conditioning apparatus 1 illustrated in FIG. 1. The heating main operation mode 1 is the operation mode in which the heating load is larger than the cooling load and at least one of the convective indoor units C11 to C13 performs cooling operation. The heating main operation mode 1 is described below with reference to FIG. 6. In FIG. 6, the convective indoor units C11 and C12 and radiant indoor units C21 and C22 perform heating operation, and the convective indoor unit C13 and radiant indoor unit C23 perform cooling operation.

In the first-side refrigerant circuit 2, the first flow switching device 106 is switched in advance such that the first-side refrigerant discharged from the compressor 103 flows into the intermediate unit 1B and the first-side refrigerant exiting from the heat-source-side heat exchanger 104 flows into the compressor 103. The valves 111*b* and 111*c* are in an open state, and the valves 111*a* and 111*d* to 111*f* are in a closed state. In the second-side refrigerant circuit, the valves 1121*b*, 1121*d*, 1122*b*, 1122*d*, 1123*a*, 1123*c*, 114*a*, 114*b*, 1151*b*, 1151*d*, 1152*b*, 1152*d*, 1153*a*, and 1153*c* are in an open state. The valves 1121*a*, 1121*c*, 1122*a*, 1122*c*, 1123*b*, 1123*d*, 114*c*, 114*d*, 1151*a*, 1151*c*, 1152*a*, 1152*c*, 1153*b*, and 1153*d* are in a closed state.

The first-side refrigerant in the low-temperature and low-pressure gaseous state is compressed by the compressor 103, becomes a high-temperature and high-pressure state, is discharged, passes through the first flow switching device 106 and check valve 113*c*, exits from the outdoor unit 1A, and flows into the intermediate unit 1B. The first-side refrigerant in the high-temperature and high-pressure state flowing to the intermediate unit 1B passes through the valve 111*b*, flows into the intermediate heat exchanger 107*b*, transfers heat to the first-side refrigerant, and is partially or entirely condensed to a gas-liquid two-phase state or a liquid state. The second-side refrigerant exiting from the intermediate heat exchanger 107*b* is expanded and decompressed by passing through the expansion mechanisms 105*b* and 105*a*, becomes a low-temperature and low-pressure gas-liquid two-phase state, and flows into the intermediate heat exchanger 107*a*. The first-side refrigerant in the gas-liquid two-phase state flowing to the intermediate heat exchanger 107*a* receives heat from the second-side refrigerant, and partially evaporates. The first-side refrigerant exiting from the intermediate heat exchanger 107*a* passes through the valve 111*c*, exits from the intermediate unit 1B, and flows into the outdoor unit 1A. The first-side refrigerant flowing to the outdoor unit 1A passes through the check valve 113*d*, flows into the heat-source-side heat exchanger 104, receives heat from the outdoor air, evaporates, becomes a low-temperature and low-pressure gaseous state, passes through the first flow switching device 106, is sucked into the compressor 103, and is compressed again.

Next, the flow of the second-side refrigerant in the second-side refrigerant circuit is described. The low-temperature second-side refrigerant ejected by driving of the pump 109*a*, passes through the valve 1123*a*, then exits from the intermediate unit 1B, and flows into the convective indoor heat exchanger 1083 in the convective indoor unit C13. The second-side refrigerant flowing to the convective indoor heat exchanger 1083 cools the indoor air, becomes a high-temperature state, exits from the convective indoor unit C13, and flows into the intermediate unit 1B.

The second-side refrigerant exiting from the convective indoor heat exchanger 1083, flowing to the intermediate unit 1B, and passing through the valve 1123*c* is divided into a portion that is to pass through the valve 114*a* and another portion that is to move toward the indoor unit C23. The second-side refrigerant flowing toward the indoor unit C23 passes through the valve 1153*a*, exits from the intermediate unit 1B, and flows into the radiant indoor heat exchanger 1163 in the indoor unit C23. The second-side refrigerant flowing to the radiant indoor heat exchanger 1163 cools the indoor air, becomes a higher temperature state, exits from the indoor unit C23, and flows into the intermediate unit 1B again. The second-side refrigerant exiting from the radiant indoor heat exchanger 1163, flowing to the intermediate unit 1B, and passing through the valve 1153*c* merges with the second-side refrigerant passing through the valve 114*a*, and the merged second-side refrigerant flows into the intermediate heat exchanger 107*a*. The second-side refrigerant flowing to the intermediate heat exchanger 107*a* is cooled by the first-side refrigerant in the low-temperature state and exits from the intermediate heat exchanger 107*a*. The second-side refrigerant exiting from the intermediate heat exchanger 107*a* flows into the pump 109*a* and is ejected again.

The high-temperature second-side refrigerant ejected by driving of the pump 109*b* is divided into portions, and the portions pass through the valves 1121*b* and 1122*b*, respectively, exit from the intermediate unit 1B, and flow into the convective indoor heat exchanger 1081 in the convective indoor unit C11 and the convective indoor heat exchanger 1082 in the convective indoor unit C12, respectively. The flows of the second-side refrigerant flowing to the convective indoor heat exchangers 1081 and 1082 heat the indoor air, become a low-temperature state, exit from the convective indoor units C11 and C12, respectively, and flow into the intermediate unit 1B. The second-side refrigerant exiting from the convective indoor heat exchanger 1081, flowing to the intermediate unit 1B, and passing through the valve 1121*d* and the second-side refrigerant exiting from the convective indoor heat exchanger 1082, flowing to the intermediate unit 1B, and passing through the valve 1122*d* merge with each other, and the merged second-side refrigerant is divided into a portion that is to pass through the valve 114*b* and another portion that is to move toward the indoor units C21 and C22. The second-side refrigerant flowing toward the indoor units C21 and C22 is divided again into portions, and the portions pass through the valves 1151*b* and 1152*b*, respectively, exit from the intermediate unit 1B, and flow into the radiant indoor heat exchanger 1161 in the indoor unit C21 and the radiant indoor heat exchanger 1162 in the indoor unit C22, respectively. The flows of the second-side refrigerant flowing to the radiant indoor heat exchangers 1161 and 1162 heat the indoor air, become a lower temperature state, exit from the indoor units C21 and C22, respectively, and flow into the intermediate unit 1B again.

The second-side refrigerant exiting from the radiant indoor heat exchanger 1161, flowing to the intermediate unit 1B, and passing through the valve 1151*d* and the second-side refrigerant exiting from the radiant indoor heat exchanger 1162, flowing to the intermediate unit 1B, and passing through the valve 1152*d* merge with the second-side refrigerant passing through the valve 114*b*, and the merged second-side refrigerant flows into the intermediate heat exchanger 107*b*. The second-side refrigerant flowing to the intermediate heat exchanger 107*b* is heated by the first-side refrigerant in the high-temperature state and exits from the intermediate heat exchanger 107*b*. The second-side refrigerant exiting from the intermediate heat exchanger 107*b* flows into the pump 109*b* and is ejected again.

(Heating Main Operation Mode 2)

Figure 7:
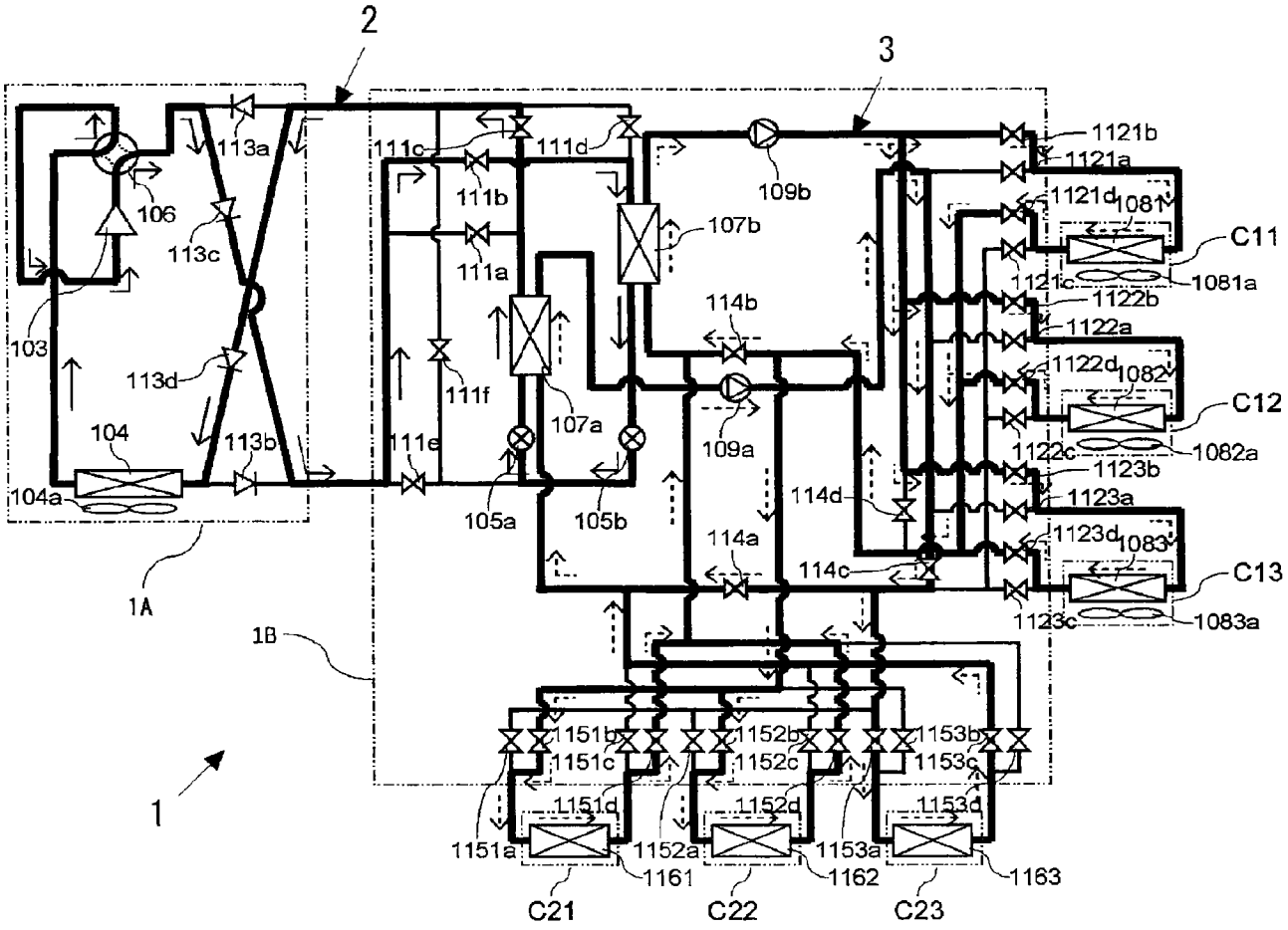
FIG. 7 is a refrigerant circuit diagram that illustrates the streams of the first-side refrigerant and the second-side refrigerant in heating main operation mode 2 in the air-conditioning apparatus 1 illustrated in FIG. 1.

FIG. 7 is a refrigerant circuit diagram that illustrates the streams of the first-side refrigerant and the second-side refrigerant in heating main operation mode 2 in the air-conditioning apparatus 1 illustrated in FIG. 1. The heating main operation mode 2 is the operation mode in which the heating load is larger than the cooling load, all of the convective indoor units C11 to C13 perform heating operation, and at least one of the indoor units C21 to C23 perform cooling operation. The heating main operation mode 2 is described below with reference to FIG. 7. In FIG. 7, the convective indoor units C11 to C13 and radiant indoor units C21 and C22 perform heating operation, and the radiant indoor unit C23 performs cooling operation.

In the first-side refrigerant circuit 2, the first flow switching device 106 is switched in advance such that the first-side refrigerant discharged from the compressor 103 flows into the heat-source-side heat exchanger 104 and the first-side refrigerant exiting from the intermediate unit 1B flows into the compressor 103. The valves 111*a*, 111*d*, 111*e*, and 111*f* are in a closed state, and the valves 111*b* and 111*c* are in an opened state. In the second-side refrigerant circuit, the valves 1121*b* to 1123*b*, 1121*d* to 1123*d*, 114*a*, 114*b*, 114*c*, 1151*b*, 1151*d*, 1152*b*, 1152*d*, 1153*a*, and 1153*c* are in an open state, and the valves 1121*a* to 1123*a*, 1121*c* to 1123*c*, 114*d*, 1151*a*, 1151*c*, 1152*a*, 1152*c*, 1153*b*, and 1153*d* are in a closed state.

The refrigerant flow in the first-side refrigerant circuit 2 is substantially the same as in the heating main operation mode 1, and the description thereof is omitted. The flow of the second-side refrigerant in the second-side refrigerant circuit is only described. The low-temperature second-side refrigerant ejected by driving of the pump 109*a* passes through the valve 114*c* and is divided into a portion that is to pass through the valve 114*a* and another portion that is to move toward the indoor unit C23. The second-side refrigerant flowing toward the indoor unit C23 passes through the valve 1153*a*, exits from the intermediate unit 1B, and flows into the radiant indoor heat exchanger 1163 in the indoor unit C23. The second-side refrigerant flowing to the radiant indoor heat exchanger 1163 cools the indoor air, becomes a high-temperature state, exits from the indoor unit C23, and flows into the intermediate unit 1B. The second-side refrigerant exiting from the radiant indoor heat exchanger 1163, flowing to the intermediate unit 1B, and passing through the valve 1153*c* merge with the second-side refrigerant passing through the valve 114*a*, and the merged second-side refrigerant flows into the intermediate heat exchanger 107*a*.

The second-side refrigerant flowing to the intermediate heat exchanger 107*a* is cooled by the first-side refrigerant in the low-temperature state and exits from the intermediate heat exchanger 107*a*. The second-side refrigerant exiting from the intermediate heat exchanger 107*a* flows into the pump 109*a* and is ejected again. The high-temperature second-side refrigerant ejected by driving of the pump 109*b* is divided into portions, and the portions pass through the valves 1121*b*, 1122*b*, and 1123*b*, respectively, exit from the intermediate unit 1B, and flow into the convective indoor heat exchanger 1081 in the convective indoor unit C11, the convective indoor heat exchanger 1082 in the convective indoor unit C12, and the convective indoor heat exchanger 1083 in the convective indoor unit C13, respectively. The flows of the second-side refrigerant flowing to the convective indoor heat exchangers 1081, 1082, and 1083 heat the indoor air, become a low-temperature state, exit from the convective indoor units C11, C12, and C13, respectively, and flow into the intermediate unit 1B.

The following flow of the second-side refrigerant merge together: the second-side refrigerant exiting from the convective indoor heat exchanger 1081, flowing to the intermediate unit 1B, and passing through the valve 1121*d*; the second-side refrigerant exiting from the convective indoor heat exchanger 1082, flowing to the intermediate unit 1B, and passing through the valve 1122*d*; and the second-side refrigerant exiting from the convective indoor heat exchanger 1083, flowing to the intermediate unit 1B, and passing through the valve 1123*d*. The merged second-side refrigerant is divided into a portion that is to pass through the valve 114*b* and another portion that is to move toward the indoor units C21 and C22. The second-side refrigerant flowing toward the indoor units C21 and C22 is divided again into portions, and the portions pass through the valves 1151*b* and 1152*b*, exit from the intermediate unit 1B, and flow into the radiant indoor heat exchanger 1161 in the indoor unit C21 and the radiant indoor heat exchanger 1162 in the indoor unit C22, respectively. The flows of the second-side refrigerant flowing to the radiant indoor heat exchangers 1161 and 1162 heat the indoor air, become a lower temperature state, exit from the indoor units C21 and C22, respectively, and flow into the intermediate unit 1B again.

The second-side refrigerant exiting from the radiant indoor heat exchanger 1161, flowing to the intermediate unit 1B, and passing through the valve 1151*d* and the second-side refrigerant exiting from the radiant indoor heat exchanger 1162, flowing to the intermediate unit 1B, and passing through the valve 1152*d* merge with the second-side refrigerant passing through the valve 114*b*, and the merged second-side refrigerant flows into the intermediate heat exchanger 107*b*. The second-side refrigerant flowing to the intermediate heat exchanger 107*b* is heated by the first-side refrigerant in the high-temperature state and exits from the intermediate heat exchanger 107*b*. The second-side refrigerant exiting from the intermediate heat exchanger 107*b* flows into the pump 109*b* and is ejected again.

(Advantages in Embodiment 1)

According to Embodiment 1 described above, the number of the convective indoor units C1*n* including the convective indoor heat exchangers 108*n* and the number of the radiant indoor units C2*m* including the radiant indoor heat exchangers 116*m* may be any number, and cooling and heating in each of the indoor units C may be freely set. Thus air-conditioning that can rise fast and that can withstand large heating and cooling loads can be performed in rooms equipped with the convective indoor units C1*n*, and uniform air-conditioning can be performed in rooms equipped with the radiant indoor units C2*m* without causing noise or draft. Accordingly, high-quality air-conditioning can be performed in all of the rooms as the entire structure in accordance with the use and load of each of the rooms.

The use of a single air-conditioning system including the convective indoor units C1*n* including the convective heat exchangers 108*n* and the radiant indoor units C2*m* including the radiant indoor heat exchangers 116*m* can achieve space and energy savings larger than those in a case where both a convective air-conditioning system and a radiant air-conditioning system are installed.

The radiant indoor heat exchangers 116*m* are disposed downflow of the convective indoor heat exchangers 108*n* in the second-side refrigerant circuit. Thus in cooling only operation mode and cooling main operation mode 1, for example, after the second-side refrigerant of 5 degrees C. is supplied to the convective indoor heat exchangers 108*n* and its temperature is raised to 15 degrees C. by heat exchange in the convective indoor heat exchangers 108*n*, the second-side refrigerant is supplied to the radiant indoor heat exchangers 116*m*.

Therefore the second-side refrigerant supplied to the radiant indoor heat exchangers 116*m* after heat exchange in the convective indoor heat exchangers 108*n* has a temperature higher than that supplied to the convective indoor heat exchangers 108*n*. Accordingly, both the convective indoor heat exchangers 108*n* and radiant indoor heat exchangers 116*m* can perform appropriate air-conditioning. That is, if the refrigerant supplied to the convective heat exchangers 108*n* and the refrigerant supplied to the radiant indoor heat exchangers 116*m* have the same temperature, a problem arises in that the capacity of the convective heat exchangers 108*n* is insufficient or the capacity of the radiant indoor heat exchangers 116*m* is excessive. In contrast, when the radiant indoor heat exchangers 116*m* are disposed downflow of the convective indoor heat exchangers 108*n*, both the convective indoor heat exchangers 108*n* and the radiant indoor heat exchangers 116*m* can perform appropriate air-conditioning.

In particular, in cooling operation, if the refrigerant with too low temperature is supplied to the radiant indoor heat exchangers 116*m*, a problem arises in that condensation occurs. When the second-side refrigerant supplied to the radiant indoor heat exchangers 116*m* has a temperature higher than that supplied to the convective indoor heat exchangers 108*n*, the occurrence of condensation in the radiant indoor heat exchangers 116*m* can be prevented.

Similarly, in heating only operation mode and heating main operation mode, the second-side refrigerant supplied to the radiant indoor heat exchangers 116*m* after heat exchange in the convective indoor heat exchangers 108*n* has a temperature lower than that supplied to the convective indoor heat exchangers 108*n*. For example, the second-side refrigerant of 45 degrees C. is supplied to the convective indoor heat exchangers 108*n*, its temperature is reduced to 130 degrees C. by heat exchange in the convective indoor heat exchangers 108*n*, and then the second-side refrigerant is supplied to the radiant indoor heat exchangers 116*m*. Accordingly, both the convective indoor heat exchangers 108*n* and the radiant indoor heat exchangers 116*m* can perform appropriate air-conditioning.

In the cooling main operation mode 2, because the valve 114*b* is in an open state and the convective indoor heat exchangers 108*n* do not perform heating, the temperature of the second-side refrigerant produced in the intermediate heat exchanger 107*b* can be slightly decreased, an input of the compressor can be reduced, and the operation efficiency is enhanced. Similarly, in heating main operation mode 2, because the valve 114*a* is in an open state and the convective indoor heat exchangers 108*n* do not perform cooling, the temperature of the second-side refrigerant produced in the intermediate heat exchanger 107*a* can be slightly increased, an input of the compressor can be reduced, and the operation efficiency can be enhanced.

Embodiment 2

FIGS. 8 to 11 are refrigerant circuit diagrams that illustrate Embodiment 2 of the air-conditioning apparatus of the present invention. An air-conditioning apparatus 100 is described with reference to FIG. 8. The same reference numerals are used in the components having the same configurations in the air-conditioning apparatus 100 in FIG. 8 as in the air-conditioning apparatus 1 in FIG. 1, and the description thereof is omitted. The air-conditioning apparatus 100 in FIG. 8 differs from the air-conditioning apparatus 1 in FIG. 1 in the configurations of the intermediate unit and indoor units.

(Configuration of Intermediate Unit 100B)

Figure 8:
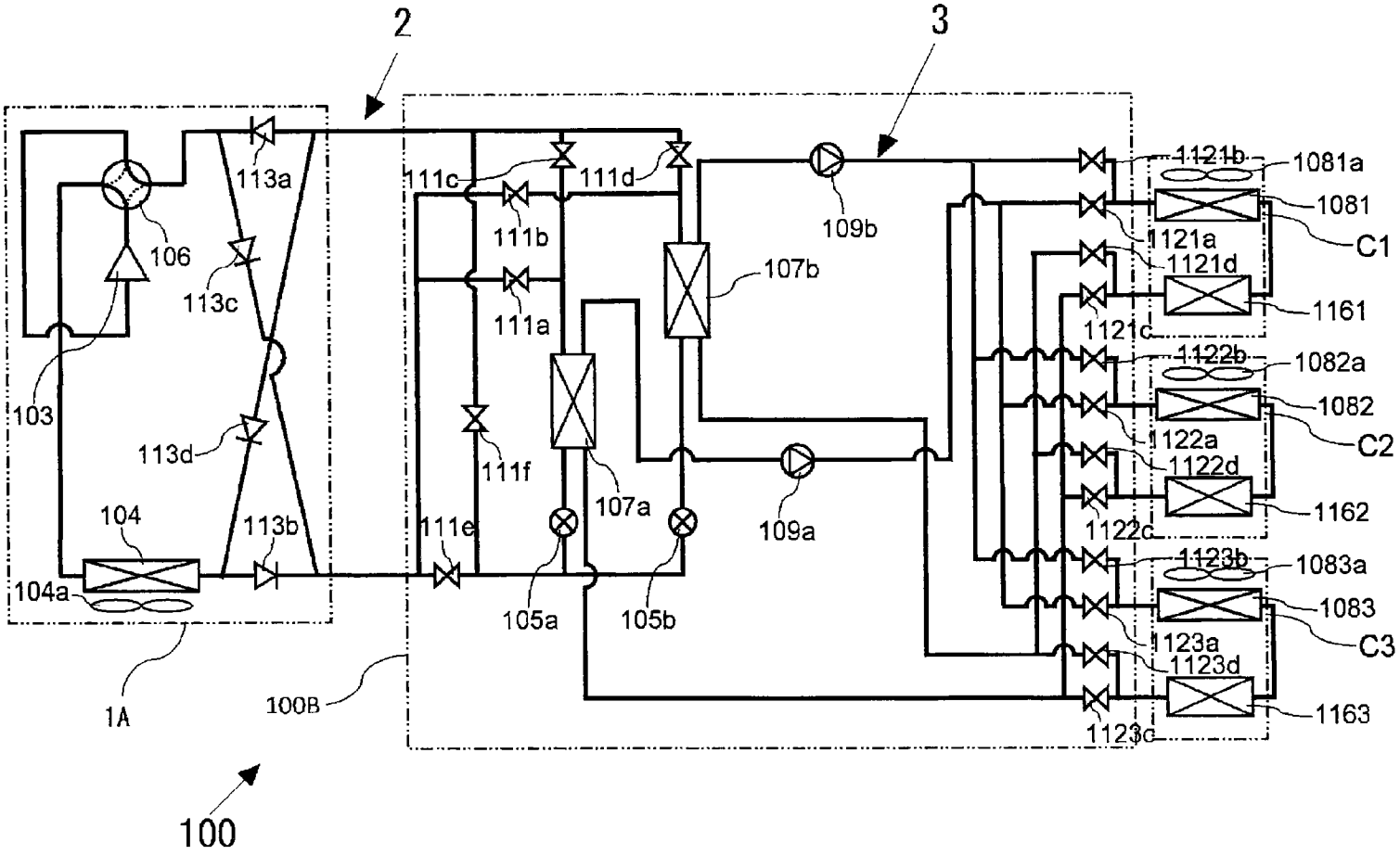
FIG. 8 is a refrigerant circuit diagram that illustrates Embodiment 2 of the air-conditioning apparatus of the present invention.

First, the intermediate unit 100B in FIG. 8 is described. The second-side refrigerant circuit in the intermediate unit 100B includes at least the intermediate heat exchangers 107*a* and 107*b*, convective indoor heat exchangers 108*n*, radiant indoor heat exchangers 116*n*, pumps 109*a* and 109*b*, and valves 112*na* to 112*nd*. The second-side refrigerant circuit is configured as the refrigerant circuit by connecting mainly the pumps 109*a* and 109*b*, convective indoor heat exchangers 108*n*, radiant indoor heat exchangers 116*n*, intermediate heat exchangers 107*a* and 107*b*, and pumps 109*a* and 109*b* in this order by the refrigerant pipes.

As in the case of Embodiment 1, the intermediate unit 100B is disposed on a location or the like different from the outdoor space and indoor space as a housing different from the outdoor unit 1A and indoor units C and connects the outdoor unit 1A and indoor units C3*n* through the refrigerant pipes. The intermediate unit 1B includes the intermediate heat exchangers 107*a* and 107*b*, expansion mechanisms 105*a* and 105*b*, pumps 109*a* and 109*b*, and valves 111*a* to 111*f* and 112*na* to 112*nd*. In the second-side refrigerant circuit, the intermediate heat exchanger 107*a* is disposed between the refrigerant pipe with which the valve 112*nc* merges and the pump 109*a*, and the intermediate heat exchanger 107*b* is disposed between the refrigerant pipe with which the valve 112*nd* merges and the pump 109*b*.

(Configuration of Indoor Unit C3*n*)

Each of the convective and radiant indoor units C3*n* performs air-conditioning by cooling operation or heating operation on an indoor space and includes the convective heat exchanger 108*n*, blower device 108*na*, and radiant indoor heat exchanger 116*n*. The valves 112*na* and 112*nb* in the intermediate unit 1006 are connected to the inlet side of the convective heat exchanger 108*n* in the indoor unit C3*n*. The discharge side of the convective heat exchanger 108*n* is connected to the inlet side of the radiant indoor heat exchanger 116*n*. The radiant indoor heat exchanger 116*n* is disposed downflow of the convective heat exchanger 108*n* and connected in series. The discharge side of the radiant indoor heat exchanger 116*n* is connected to the valves 112*nc* and 112*nd* in the intermediate unit 1006. The indoor air or outside air supplied from the blower device 108*na* exchanges heat with the second-side refrigerant in the indoor heat exchanger 108*n*, and then it exchanges heat again with the second-side refrigerant in the radiant indoor heat exchanger 116*n*. In FIG. 8, the number n of the convective and radiant indoor units C3*n* connected is three. The number n is not limited to three, and any number of the convective and radiant indoor units C3*n* may be used.

FIGS. 9 to 14 are refrigerant circuit diagrams that illustrate example streams of the first-side refrigerant and the second-side refrigerant in operation modes. Example operations in the air-conditioning apparatus 100 in each operation mode are described with reference to FIGS. 9 to 14. The flow of the first-side refrigerant is substantially the same as in Embodiment 1 described above (see FIGS. 2 to 7), and the flow of the second-side refrigerant is only described below.

(Cooling Only Operation Mode)

Figure 9:
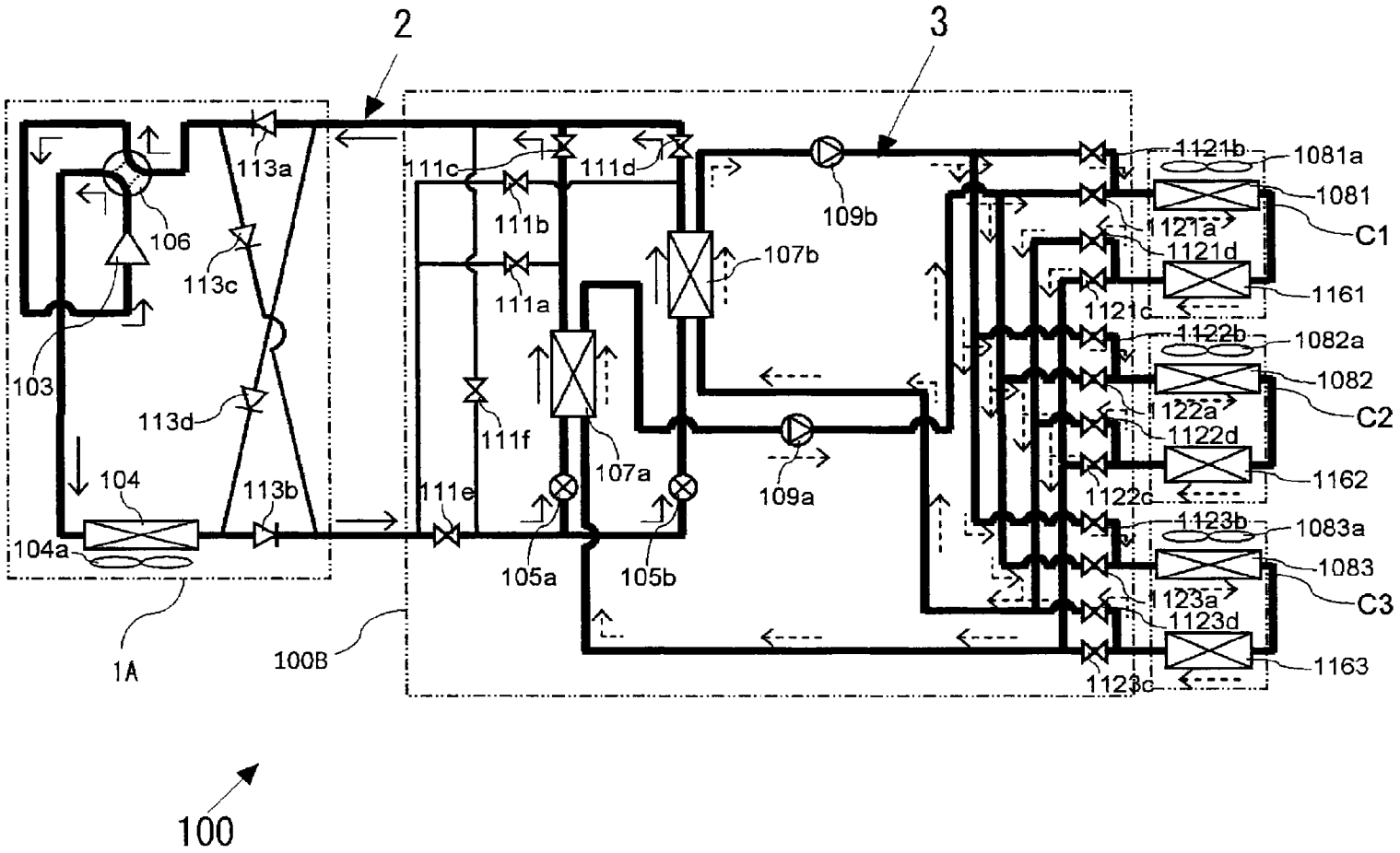
FIG. 9 is a refrigerant circuit diagram that illustrates the streams of the first-side refrigerant and the second-side refrigerant in cooling only operation mode in the air-conditioning apparatus illustrated in FIG. 8.

FIG. 9 is a refrigerant circuit diagram that illustrates the streams of the first-side refrigerant and second-side refrigerant in cooling only operation mode in the air-conditioning apparatus 100 illustrated in FIG. 8. In FIG. 9, the pipes indicated by the thick lines represent the pipes through which the first-side refrigerant and second-side refrigerant pass, the directions in which the first-side refrigerant flows are indicated by the solid line arrows, and the directions in which the second-side refrigerant flows are indicated by the broken line arrows. The same applies to FIGS. 10 to 12. The cooling only operation mode is described below with reference to FIG. 9.

The flow of the second-side refrigerant in the second-side refrigerant circuit is described here. In the second-side refrigerant circuit, the valves 112*na* to 112*nd* are set in an open state in advance. The low-temperature second-side refrigerant ejected by driving of the pump 109*a* is divided into portions, and the portions pass through the valves 1121*a*, 1122*a*, and 1123*a*, respectively, then exit from the intermediate unit 1B, and flow into the convective indoor heat exchanger 1081 in the convective and radiant indoor unit C31, the convective indoor heat exchanger 1082 in the convective and radiant indoor unit C32, and the convective indoor heat exchanger 1083 in the convective and radiant indoor unit C33, respectively. The low-temperature second-side refrigerant ejected by driving of the pump 109*b* is divided into portions, and the portions pass through the valves 1121*b*, 1122*b*, and 1123*b*, respectively, then exit from the intermediate unit 1B, and flow into the convective indoor heat exchanger 1081 in the convective and radiant indoor unit C31, the convective indoor heat exchanger 1082 in the convective and radiant indoor unit C2, and the convective indoor heat exchanger 1083 in the convective and radiant indoor unit C33, respectively.

The flows of the second-side refrigerant flowing to the convective indoor heat exchangers 1081, 1082, and 1083 cool the indoor air or outside air, become a high-temperature state, and flow into the radiant indoor heat exchangers 1161, 1162, respectively. The flows of the second-side refrigerant flowing to the radiant indoor heat exchangers 1161, 1162, and 1163 cool the air subjected to heat treatment in the convective indoor heat exchangers 1081, 1082, and 1083, respectively, and indoor air, become a higher temperature state, exit from the convective and radiant indoor units C31, C32, and C33, respectively, and flow into the intermediate unit 1B.

A portion of the second-side refrigerant that passes through the valve 1121*c* after being divided from the second-side refrigerant exiting from the radiant indoor heat exchanger 1161 and flowing to the intermediate unit 1B, a portion of the second-side refrigerant that passes through the valve 1122*c* after being divided from the second-side refrigerant exiting from the radiant indoor heat exchanger 1162 and flowing to the intermediate unit 1B, and a portion of the second-side refrigerant that passes through the valve 1123*c* after being divided from the second-side refrigerant exiting from the radiant indoor heat exchanger 1163 and flowing to the intermediate unit 1B merge together, and the merged second-side refrigerant flows into the intermediate heat exchanger 107*a*. Another portion of the second-side refrigerant that passes through the valve 1121*d* after being divided from the second-side refrigerant exiting from the radiant indoor heat exchanger 1161 and flowing to the intermediate unit 1B, another portion of the second-side refrigerant that passes through the valve 1122*d* after being divided from the second-side refrigerant exiting from the radiant indoor heat exchanger 1162 and flowing to the intermediate unit 1B, and another portion of the second-side refrigerant that passes through the valve 1123*d* after being divided from the second-side refrigerant exiting from the radiant indoor heat exchanger 1163 and flowing to the intermediate unit 1B merge together, and the merged second-side refrigerant flows into the intermediate heat exchanger 107*b*.

The flows of the second-side refrigerant flowing to the intermediate heat exchangers 107*a* and 107*b* are cooled by the first-side refrigerant in the low-temperature state and exit from the intermediate heat exchangers 107*a* and 107*b*, respectively. The flows of the second-side refrigerant exiting from the intermediate heat exchangers 107*a* and 107*b* flow into the pumps 109*a* and 109*b*, respectively, and are ejected again.

(Heating Only Operation Mode)

Figure 10:
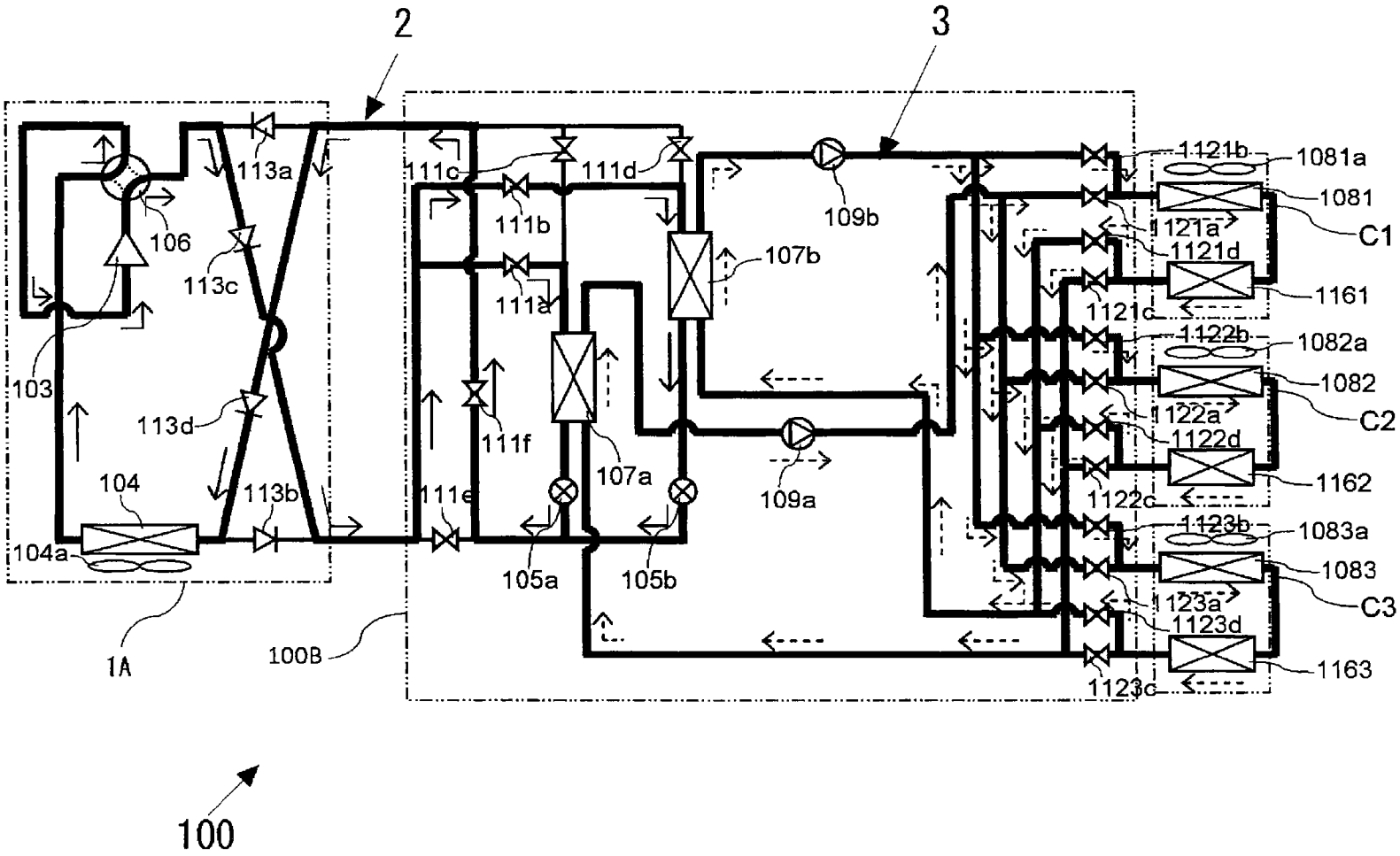
FIG. 10 is a refrigerant circuit diagram that illustrates the streams of the first-side refrigerant and the second-side refrigerant in heating only operation mode in the air-conditioning apparatus illustrated in FIG. 8.

FIG. 10 is a refrigerant circuit diagram that illustrates the streams of the first-side refrigerant and second-side refrigerant in heating only operation mode in the air-conditioning apparatus 100 illustrated in FIG. 8. The heating only operation mode is described below with reference to FIG. 10. The flow of the second-side refrigerant in the second-side refrigerant circuit is described here. The flow of the second-side refrigerant is substantially the same as in cooling only operation mode. In the second-side refrigerant circuit, the valves 112*na* to 112*nd* are set in an open state in advance.

The high-temperature second-side refrigerant ejected by driving of the pump 109*a* is divided into portions, and the portions pass through the valves 112*na*, 1122*a*, and 1123*a*, respectively, then exit from the intermediate unit 1B, and flow into the convective indoor heat exchanger 1081 in the convective and radiant indoor unit C31, the convective indoor heat exchanger 1082 in the convective and radiant indoor unit C32, and the convective indoor heat exchanger 1083 in the convective and radiant indoor unit C33, respectively. The high-temperature second-side refrigerant ejected by driving of the pump 109*b* is divided into portions, and the portions pass through the valves 1121*b*, 1122*b*, and 1123*b*, respectively, then exit from the intermediate unit 1B, and flow into the convective indoor heat exchanger 1081 in the convective indoor unit C1, the convective indoor heat exchanger 1082 in the convective and radiant indoor unit C32, and the convective indoor heat exchanger 1083 in the convective and radiant indoor unit C33, respectively.

The flows of the second-side refrigerant flowing to the convective indoor heat exchangers 1081, 1082, and 1083 heat the indoor air or outside air, become a low-temperature state, and flow into the radiant indoor heat exchangers 1161, 1162, and 1163, respectively. The flows of the second-side refrigerant flowing to the radiant indoor heat exchangers 1161, 1162, and 1163 heat the air subjected to heat treatment in the convective indoor heat exchangers 1081, 1082, and 1083, respectively, and indoor air, become a lower temperature state, exit from the convective and radiant indoor units C31, C32, and C33, respectively, and flow into the intermediate unit 1B.

A portion of the second-side refrigerant that passes through the valve 1121*c* after being divided from the second-side refrigerant exiting from the radiant indoor heat exchanger 1161 and flowing to the intermediate unit 1B, a portion of the second-side refrigerant that passes through the valve 1122*c* after being divided from the second-side refrigerant exiting from the radiant indoor heat exchanger 1162 and flowing to the intermediate unit 1B, and a portion of the second-side refrigerant that passes through the valve 1123*c* after being divided from the second-side refrigerant exiting from the radiant indoor heat exchanger 1163 and flowing to the intermediate unit 1B merge together, and the merged second-side refrigerant flows into the intermediate heat exchanger 107*a*. Another portion of the second-side refrigerant that passes through the valve 1121*d* after being divided from the second-side refrigerant exiting from the radiant indoor heat exchanger 1161 and flowing to the intermediate unit 1B, another portion of the second-side refrigerant that passes through the valve 1122*d* after being divided from the second-side refrigerant exiting from the radiant indoor heat exchanger 1162 and flowing to the intermediate unit 1B, and another portion of the second-side refrigerant that passes through the valve 1123*d* after being divided from the second-side refrigerant exiting from the radiant indoor heat exchanger 1163 and flowing to the intermediate unit 1B merge together, and the merged second-side refrigerant flows into the intermediate heat exchanger 107*b*.

The flows of the second-side refrigerant flowing to the intermediate heat exchangers 107*a* and 107*b* are heated by the first-side refrigerant in the high-temperature state and exit from the intermediate heat exchangers 107*a* and 107*b*, respectively. The flows of the second-side refrigerant exiting from the intermediate heat exchangers 107*a* and 107*b* flow into the pumps 109*a* and 109*b*, respectively, and are ejected again.

(Cooling Main Operation Mode)

Figure 11:
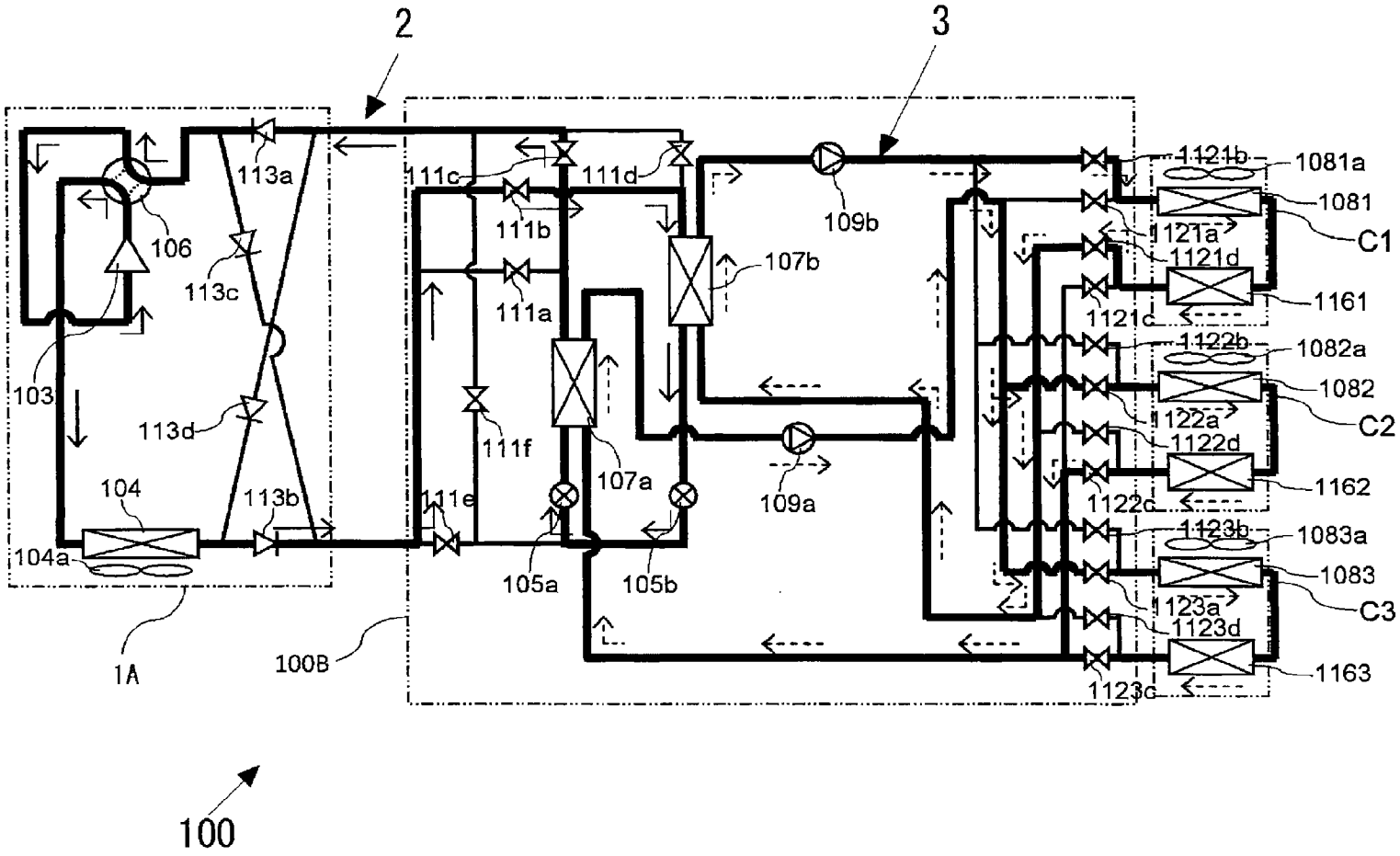
FIG. 11 is a refrigerant circuit diagram that illustrates the streams of the first-side refrigerant and the second-side refrigerant in cooling main operation mode in the air-conditioning apparatus illustrated in FIG. 8.

FIG. 11 is a refrigerant circuit diagram that illustrates the streams of the first-side refrigerant and the second-side refrigerant in cooling main operation mode in the air-conditioning apparatus 100 illustrated in FIG. 8. The cooling main operation mode is described below with reference to FIG. 11. In FIG. 11, the convective and radiant indoor unit C31 performs heating operation, and the convective and radiant indoor units C32 and C33 perform cooling operation.

The flow of the second-side refrigerant in the second-side refrigerant circuit is described here. In the second-side refrigerant circuit, the valves 1121*b*, 1121*d*, 1122*a*, 1122*c*, 1123*a*, and 1123*c* are set in an open state in advance, and the valves 1121*a*, 1121*c*, 1122*b*, 1122*d*, 1123*b*, and 1123*d* are set in a closed state in advance.

The low-temperature second-side refrigerant ejected by driving of the pump 109*a* is divided into portions, and the portions pass through the valves 1122*a* and 1123*a*, respectively, then exit from the intermediate unit 1B, and flow into the convective indoor heat exchanger 1082 in the convective and radiant indoor unit C32 and the convective indoor heat exchanger 1083 in the convective and radiant indoor unit C33, respectively.

The flows of the second-side refrigerant flowing to the convective indoor heat exchangers 1082 and 1083 cool the indoor air or outside air, become a high-temperature state, and flow into the radiant indoor heat exchangers 1162 and 1163, respectively. The flows of the second-side refrigerant flowing to the radiant indoor heat exchangers 1162 and 1163 cool the air subjected to heat treatment in convective indoor heat exchangers 1082 and 1083, respectively, and indoor air, become a higher temperature state, exit from the convective and radiant indoor units C32 and C33, respectively, and flow into the intermediate unit 1B.

The second-side refrigerant exiting from the radiant indoor heat exchanger 1162, flowing to the intermediate unit 1B, and passing through the valve 1122*c* and the second-side refrigerant exiting from the radiant indoor heat exchanger 1163, flowing to the intermediate unit 1B, and passing through the valve 1123*c* merge with each other, and the merged second-side refrigerant flows into the intermediate heat exchanger 107*a*. The second-side refrigerant flowing to the intermediate heat exchanger 107*a* is cooled by the first-side refrigerant in the low-temperature state and exits from the intermediate heat exchanger 107*a*. The second-side refrigerant exiting from the intermediate heat exchanger 107*a* flows into the pump 109*a* and is ejected again. The high-temperature second-side refrigerant ejected by driving of the pump 109*b* passes through the valve 1121*b*, then exits from the intermediate unit 1B, and flows into the convective indoor heat exchanger 1081 in the convective and radiant indoor unit C31.

The second-side refrigerant flowing to the convective indoor heat exchanger 1081 heats the indoor air, becomes a low-temperature state, and flows into the radiant indoor heat exchanger 1161. The second-side refrigerant flowing to the radiant indoor heat exchanger 1161 heats the air subjected to heat treatment in the convective indoor heat exchanger 1081 and indoor air, becomes a lower temperature state, exits from the convective and radiant indoor unit C31, and flows into the intermediate unit 1B.

The second-side refrigerant exiting from the radiant indoor heat exchanger 1161, flowing to the intermediate unit 1B, and passing through the valve 1121*d* flows into the intermediate heat exchanger 107*b*. The second-side refrigerant flowing to the intermediate heat exchanger 107*b* is heated by the first-side refrigerant in the high-temperature state and exits from the intermediate heat exchanger 107*b*. The second-side refrigerant exiting from the intermediate heat exchanger 107*b* flows into the pump 109*b* and is ejected again.

(Heating Main Operation Mode)

Figure 12:
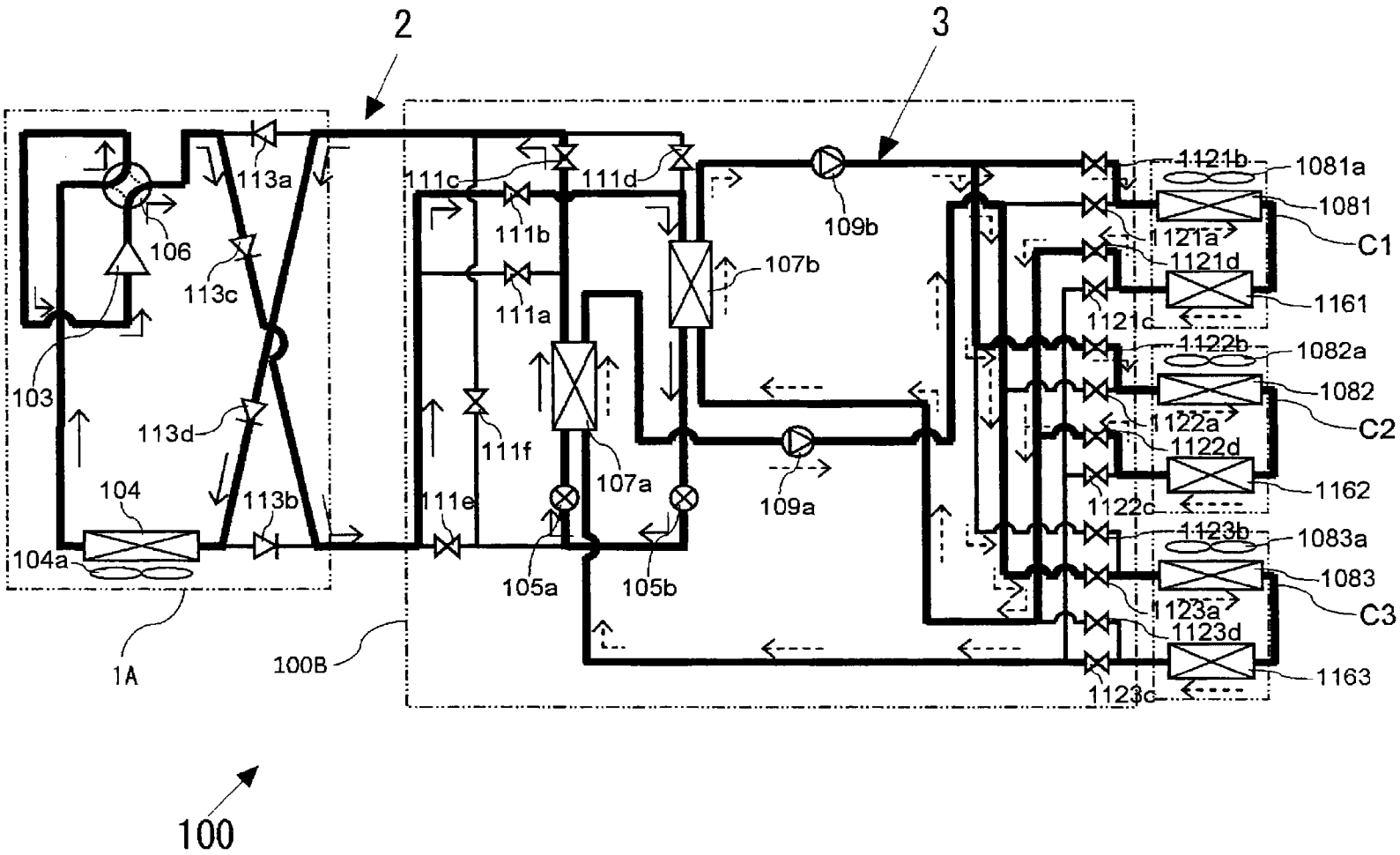
FIG. 12 is a refrigerant circuit diagram that illustrates the streams of the first-side refrigerant and the second-side refrigerant in heating main operation mode in the air-conditioning apparatus illustrated in FIG. 8.

FIG. 12 is a refrigerant circuit diagram that illustrates the streams of the first-side refrigerant and the second-side refrigerant in heating main operation mode in the air-conditioning apparatus 100 illustrated in FIG. 8. The heating main operation mode is described below with reference to FIG. 12. In FIG. 12, the convective and radiant indoor units C31 and C32 perform heating operation, and the convective and radiant indoor unit C33 performs cooling operation.

The flow of the second-side refrigerant in the second-side refrigerant circuit is described here. In the second-side refrigerant circuit, the valves 1121*b*, 1121*d*, 1122*b*, 1122*d*, 1123*a*, and 1123*c* are set in an open state in advance, and the valves 1121*a*, 1121*c*, 1122*a*, 1122*c*, 1123*b*, and 1123*d* are set in a closed state in advance.

The low-temperature second-side refrigerant ejected by driving of the pump 109*a* passes through the valve 1123*a*, then exits from the intermediate unit 1B, and flows into the convective indoor heat exchanger 1083 in the convective and radiant indoor unit C33. The second-side refrigerant flowing to the convective indoor heat exchanger 1083 cools the indoor air, becomes a high-temperature state, and flows into the radiant indoor heat exchanger 1163. The second-side refrigerant flowing to the radiant indoor heat exchanger 1163 heats the air subjected to heat treatment in the convective indoor heat exchanger 1083 and indoor air, becomes a higher temperature state, exits from the convective and radiant indoor unit C31, and flows into the intermediate unit 1B.

The second-side refrigerant exiting from the radiant indoor heat exchanger 1163, flowing to the intermediate unit 1B, and passing through the valve 1123*c* flows into the intermediate heat exchanger 107*a*. The second-side refrigerant flowing to the intermediate heat exchanger 107*a* is cooled by the first-side refrigerant in the low-temperature state and exits from the intermediate heat exchanger 107*a*. The second-side refrigerant exiting from the intermediate heat exchanger 107*a* flows into the pump 109*a* and is ejected again. The high-temperature second-side refrigerant ejected by driving of the pump 109*b* is divided into portions, and the portions pass through the valves 1121*b* and 1122*b*, respectively, then exit from the intermediate unit 1B, and flow into the convective indoor heat exchanger 1081 in the convective and radiant indoor unit C31 and the convective indoor heat exchanger 1082 in the convective and radiant indoor unit C32, respectively.

The flows of the second-side refrigerant flowing to the convective indoor heat exchangers 1081 and 1082 heat the indoor air or outside air, become a low-temperature state, and flow into the radiant indoor heat exchangers 1161 and 1162, respectively. The flows of the second-side refrigerant flowing to the radiant indoor heat exchangers 1161 and 1162 heat the air subjected to heat treatment in convective indoor heat exchanger 1083 and indoor air, become a lower temperature state, exit from the convective and radiant indoor units C31 and C32, respectively, and flow into the intermediate unit 1B.

The second-side refrigerant exiting from the radiant indoor heat exchanger 1161, flowing to the intermediate unit 1B, and passing through the valve 1121*d* and the second-side refrigerant exiting from the radiant indoor heat exchanger 1162, flowing to the intermediate unit 1B, and passing through the valve 1122*d* merge with each other, and the merged second-side refrigerant flows into the intermediate heat exchanger 107*b*. The second-side refrigerant flowing to the intermediate heat exchanger 107*b* is heated by the first-side refrigerant in the high-temperature state and exits from the intermediate heat exchanger 107*b*. The second-side refrigerant exiting from the intermediate heat exchanger 107*b* flows into the pump 109*b* and is ejected again.

(Advantages in Embodiment 2)

According to Embodiment 2 described above, because the indoor unit includes both the convective indoor heat exchanger 108*n* and the radiant indoor heat exchanger 116*n*, the air-conditioning apparatus can perform air-conditioning that supports a large thermal load and that causes no or slight discomfort provided by noise or draft. In particular, in cooling operation, making the temperature of air with a humidity reduced by being cooled by the convective indoor heat exchanger 108*n* appropriate by the radiant indoor heat exchanger 116*n* and blowing that air into the room enables handling not only a sensible heat load but also a latent heat load. The refrigerant pipes can be reduced with respect to the heat exchange capacity and the cost can be reduced, in comparison with Embodiment 1.

(Examples of Placement of Indoor Unit in Embodiment 2)

Figure 13:
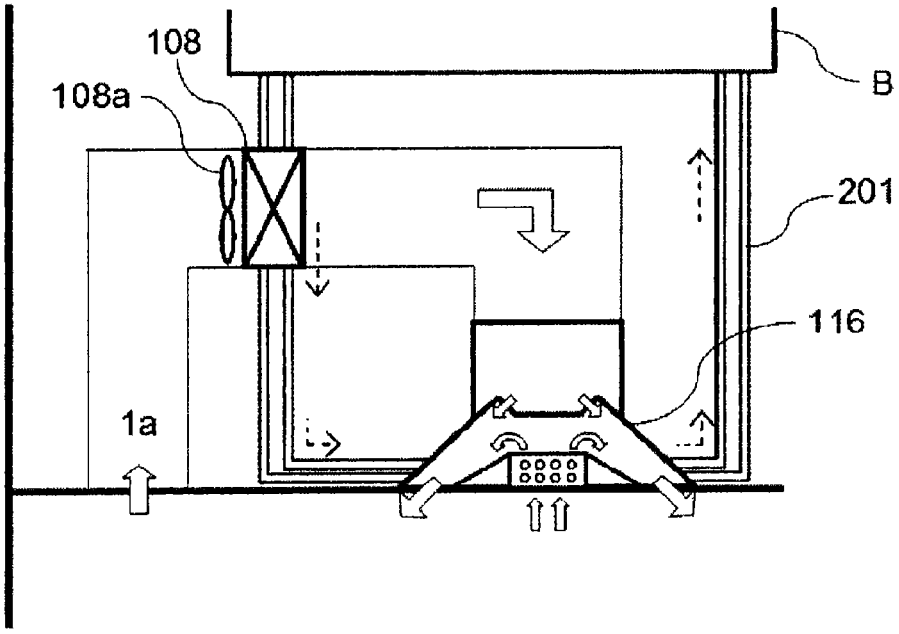
FIG. 13 illustrates an example of placement of an indoor unit in the air-conditioning apparatus illustrated in FIG. 8.
Figure 14:
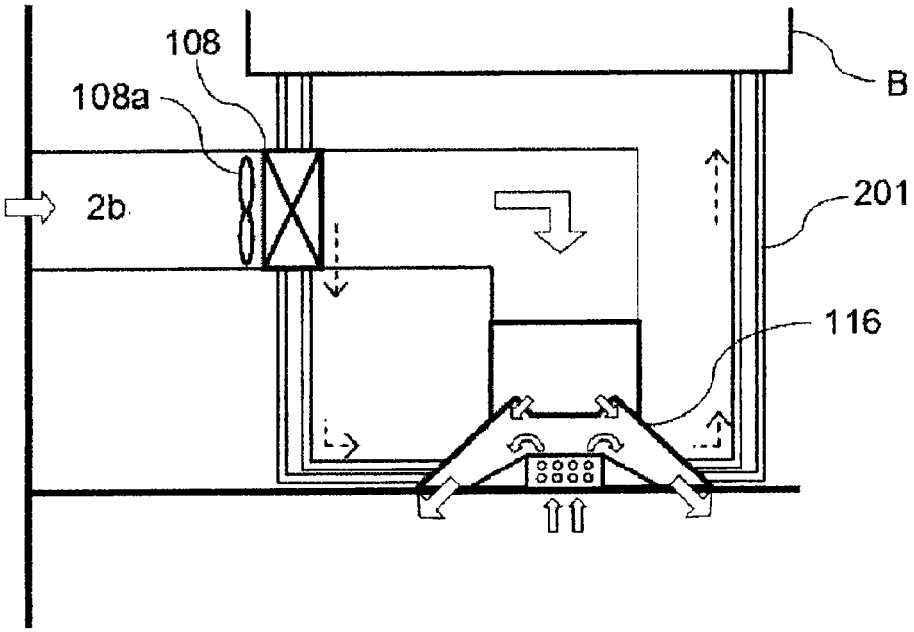
FIG. 14 illustrates another example of placement of the indoor unit in the air-conditioning apparatus illustrated in FIG. 8.
Figure 15:
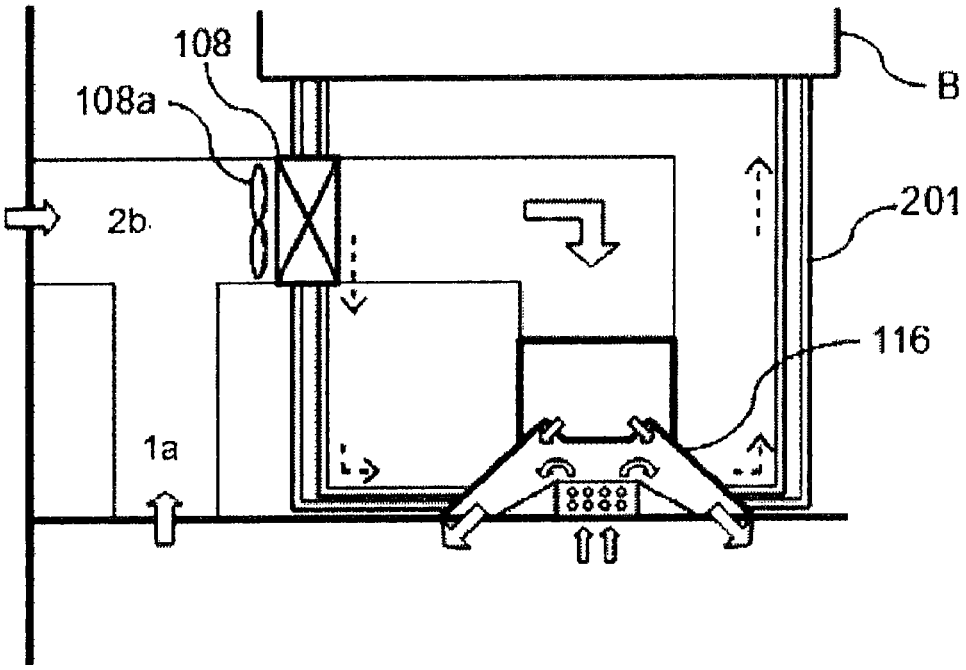
FIG. 15 illustrates another example of placement of the indoor unit in the air-conditioning apparatus illustrated in FIG. 8.

FIGS. 13 to 15 illustrate examples of placement of the convective and radiant indoor unit C3*n* in the air-conditioning apparatus 100 according to Embodiment 2. In FIG. 13, the convective indoor heat exchanger 108 and the radiant indoor heat exchanger 116 are connected to the intermediate unit 1B by the second-side refrigerant pipe. The broken line arrows indicate the directions in which the second-side refrigerant flows. The second-side refrigerant exiting from the intermediate unit 1B runs through the convective indoor heat exchanger 108*n* and the radiant indoor heat exchanger 116*n* in this order and flows into the intermediate unit 1B.

In the example placement illustrated in FIG. 13, indoor air 1*a* is sucked by the blower device 108*a*, exchanges heat in the convective heat exchanger 108*n*, then exchanges heat in the radiant indoor heat exchanger 116*n*, and air-conditioning is thus performed. In the example placement illustrated in FIG. 14, outside air 1*b* is sucked by the blower device 108*a*, exchanges heat in the convective heat exchanger, then exchanges heat in the radiant indoor heat exchanger 116*m*, and ventilation and air-conditioning are thus performed. In the example placement illustrated in FIG. 15, the indoor air 1*a* and outside air 1*b* are sucked by the blower device 108*a*, exchanges heat in the convective heat exchanger, then exchanges heat in the radiant indoor heat exchanger 116, and ventilation and air-conditioning are thus performed. The ratio between the indoor air and the outside air may be adjusted depending on the temperature of the outside air or the quality of the indoor air. With this manner, the sensible heat cooling capacity can be improved, and the occurrence of condensation in the radiant indoor heat exchanger 116*n* can be prevented.

Embodiment 3

Figure 16:
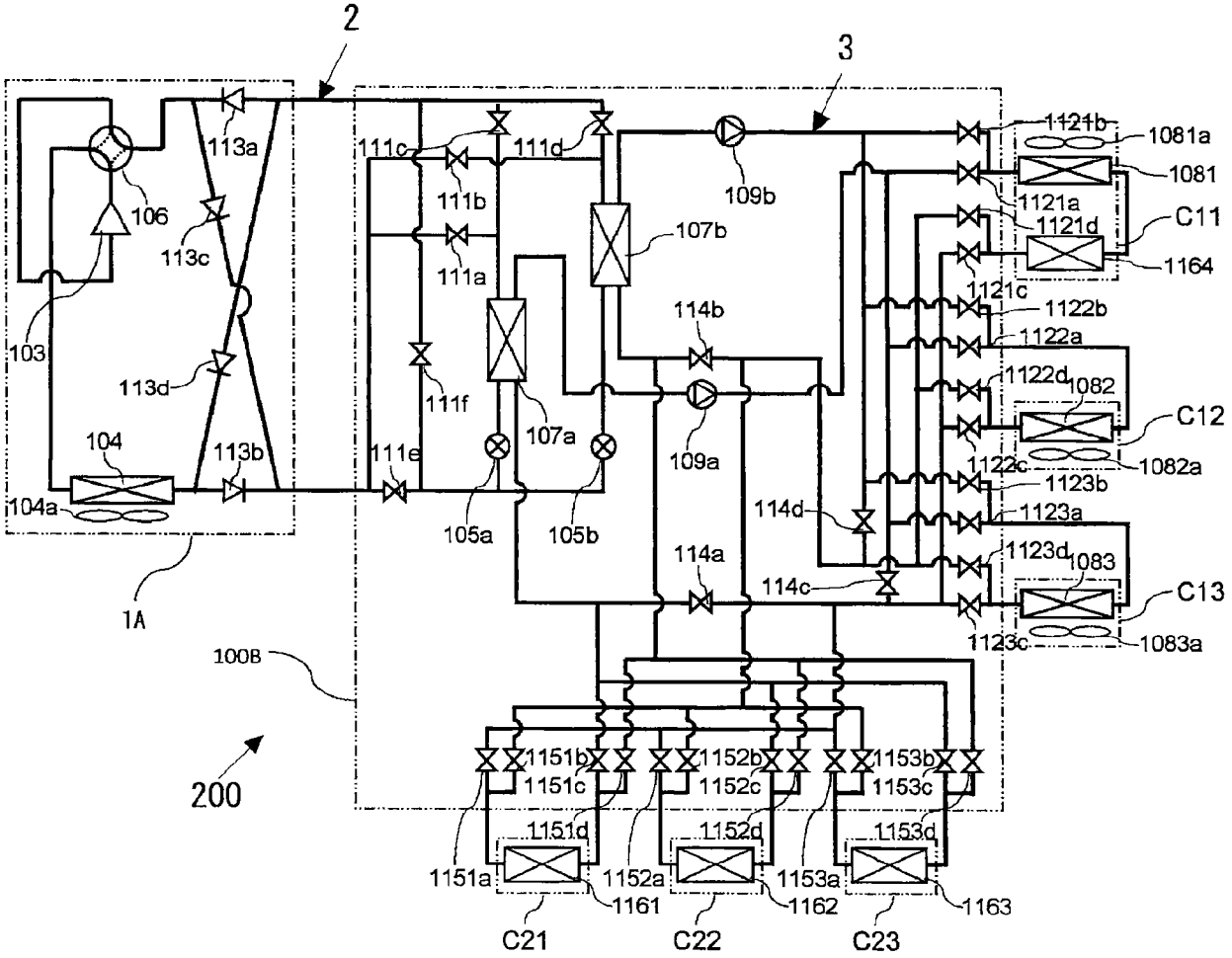
FIG. 16 is a refrigerant circuit diagram that illustrates Embodiment 3 of the air-conditioning apparatus of the present invention.

FIG. 16 is a refrigerant circuit diagram that illustrates Embodiment 3 of the air-conditioning apparatus of the present invention. An air-conditioning apparatus 200 is described with reference to FIG. 16. The same reference numerals are used in the components having the same configurations in the air-conditioning apparatus 200 in FIG. 16 as in the air-conditioning apparatuses 1 and 100 in FIGS. 1 and 8, and the description thereof is omitted. The air-conditioning apparatus 200 in FIG. 16 differs from the air-conditioning apparatuses 1 and 100 in FIGS. 1 and 8 in that three different types of the convective indoor units C1, C2, and C3 are connected to the intermediate unit 1B.

Specifically, the air-conditioning apparatus 200 includes the convective and radiant indoor unit C31 including both the convective indoor heat exchanger 1081 and a radiant indoor heat exchanger 1164, the convective indoor units C12 and C13 including only the convective indoor heat exchangers 1081 and 1082, respectively, as a heat exchanger, and indoor units C21 to C23 including only the radiant indoor heat exchangers 116*m*, respectively, as a heat exchanger. The configuration of each element and the streams of the refrigerants in operation modes are similar to those in Embodiments 1 and 2. According to Embodiment 3 described above, because the single air-conditioning apparatus 200 can install three types of indoor units, air-conditioning can be performed in accordance with the use and load of each room, while at the same time space and energy savings are achieved.

Embodiments in the present invention are not limited to Embodiments 1 to 3 described above. Embodiments described above illustrate an example case where the two intermediate heat exchangers 107*a* and 107*b* are disposed inside the intermediate unit 1B. Two or more intermediate heat exchangers may also be used.

The examples illustrated in FIGS. 13 to 15 are not limited to the illustrated ones. The radiant indoor heat exchangers may be of the so-called active chilled beam type or passive chilled beam type.

REFERENCE SIGNS LIST

1, 100, 200 air-conditioning apparatus 1A outdoor unit 1B, 100B intermediate unit 2 first-side refrigerant circuit 3 second-side refrigerant circuit 103 compressor 104 heat-source-side heat exchanger 104*a* fan 105*a*, 105*b* expansion mechanism 106 first flow switching device 107*a*, 107*b* intermediate heat exchanger 108*n* convective indoor heat exchanger 108*na* blower device 109*a*, 109*b* pump 111*a*-111*f* valve (flow switching device) 112*na* valve 112*nb* valve 112*nc* valve 112*nd* valve 113*a*-113*d* check valve 115*ma* valve 115*mb* valve 115*mc* valve 115*md* valve 116 radiant indoor heat exchanger 116*n* radiant indoor heat exchanger C1*n* convective indoor unit C2*m* radiant indoor unit C3 convective and radiant indoor unit.

The invention claimed is:

1. An air-conditioning apparatus comprising:

an outdoor unit including a compressor configured to compress a first-side refrigerant and a heat-source-side heat exchanger configured to cause heat exchange between air and the first-side refrigerant;

a plurality of indoor units including indoor heat exchangers configured to cause heat exchange between the air and a second-side refrigerant;

a plurality of intermediate heat exchangers configured to cause heat exchange between the first-side refrigerant and the second-side refrigerant, the intermediate heat exchangers being connected to the outdoor unit by a first-side refrigerant pipe and connected to the indoor units by a plurality of second-side refrigerant pipes; and a flow switching device configured to switch combination of connection between each of the indoor units and each of the intermediate heat exchangers, wherein the plurality of indoor units include convective indoor units and radiant indoor units, each of the convective indoor units includes a convective indoor heat exchanger, and each of the radiant indoor units includes a radiant indoor heat exchanger, wherein the second-side refrigerant flowing out of each of the convective indoor units in a cooling operation flows into each of the radiant indoor units, and wherein the second-side refrigerant is supplied to each of the radiant indoor heat exchanger after the temperature of the second-side refrigerant rises by the heat exchange of the convective indoor heat exchanger.

2. The air-conditioning apparatus of claim 1, wherein the plurality of convective indoor units are connected in parallel with each other in the plurality of indoor units, and the second-side refrigerant flowing out of the plurality of convective indoor units merge and thereafter flows in the radiant indoor units.

3. The air-conditioning apparatus of claim 1, wherein the plurality of radiant indoor units are connected in parallel with each other in the plurality of indoor units, and the second-side refrigerant flowing out of the plurality of convective indoor units merge and are thereafter divided into a plurality of portions flowing respectively in the radiant indoor units.

4. The air-conditioning apparatus of claim 1, further comprising an intermediate unit including the plurality of heat exchangers and the flow switching device as separate units from the convective indoor units and the radiant indoor units, the second-side refrigerant flowing out of the convective indoor units flows in the intermediate unit and thereafter passes through the flow switching device, flows out of the intermediate unit, and flow in the radiant indoor units.

5. The air-conditioning apparatus of claim 1, further comprising pipes and valves for supplying the second-side refrigerant to the radiant indoor units by bypassing the plurality of convective indoor units.

6. The air-conditioning apparatus of claim 1, further comprising pipes and valves for supplying the second-side refrigerant to the plurality of radiant indoor units by bypassing the plurality of convective heat exchangers and pipes and valves for bypassing the plurality of radiant indoor units.

7. The air-conditioning apparatus of claim 1, further comprising a plurality of expansion mechanisms and a plurality of second flow switching devices in a middle of a plurality of flow paths of the first-side refrigerant, the flow path being connected to the plurality of intermediate heat exchangers, the plurality of second flow switching devices switching a state of flow of refrigerant to a state in which the first-side refrigerant flowing to the intermediate heat exchangers flows through the plurality of expansion mechanisms, and in which the intermediate heat exchangers include both an intermediate heat exchanger transferring heat to the second-side refrigerant and an intermediate heat exchanger absorbing heat from the second-side refrigerant.

8. The air-conditioning apparatus of claim 1, wherein the plurality of convective indoor units and the plurality of radiant indoor units are each disposed in separate rooms of a building.

9. The air-conditioning apparatus of claim 1, wherein in each of the cooling operation and a heating operation, the second-side refrigerant flows out of each of the convective indoor units and flows into each of the radiant indoor units.

* * * * *